US006675969B1

(12) United States Patent
Kiyohara et al.

(10) Patent No.: US 6,675,969 B1
(45) Date of Patent: Jan. 13, 2004

(54) PACKING BOX

(75) Inventors: Nobuyoshi Kiyohara, Sayama (JP); Takashi Usui, Sayama (JP); Eiji Kuriyama, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/868,366

(22) PCT Filed: Dec. 24, 1999

(86) PCT No.: PCT/JP99/07251

§ 371 (c)(1),
(2), (4) Date: Aug. 6, 2001

(87) PCT Pub. No.: WO00/38997

PCT Pub. Date: Jul. 6, 2000

(30) Foreign Application Priority Data

| | | |
|---|---|---|
| Dec. 25, 1998 | (JP) | 10-376893 |
| Dec. 25, 1998 | (JP) | 10-376894 |
| Nov. 19, 1999 | (JP) | 11-330635 |

(51) Int. Cl.[7] ..... B65D 5/00

(52) U.S. Cl. ..... 206/448; 229/103.2

(58) Field of Search ..... 229/103.2, 101, 229/103.3; 206/335, 448

(56) References Cited

U.S. PATENT DOCUMENTS

| | | | | | |
|---|---|---|---|---|---|
| 1,449,468 | A | * | 3/1923 | Walter | 229/125.37 |
| 2,791,363 | A | | 5/1957 | Boeye | |
| 3,896,932 | A | * | 7/1975 | Giebel et al. | 206/335 |
| 3,921,890 | A | * | 11/1975 | Reihm | 206/454 |
| 3,978,982 | A | | 9/1976 | Duncan | |

FOREIGN PATENT DOCUMENTS

| | | |
|---|---|---|
| FR | 2 592 862 | 7/1987 |
| JP | 60-92918 | 12/1983 |
| JP | 2-48516 | 9/1988 |

* cited by examiner

*Primary Examiner*—Jacob K. Ackun
(74) *Attorney, Agent, or Firm*—Merchant & Gould, P.C.

(57) ABSTRACT

A packing box for receiving and packing a product (W1; W4) having at least one bent portion is erected from a single sideways-long rectangular base sheet (10; 110). The base sheet includes a plurality of folding lines and slits for initiating the folding of the sheet. The packing box is erected by folding the sheet along the lines and slits. The product can be packed while erecting the box.

10 Claims, 17 Drawing Sheets

PACKING BOX

TECHNICAL FIELD

The present invention relates to an L- or U-shaped packing box erected by folding a single base sheet.

BACKGROUND ART

A packing box of corrugated cardboard is known which has an L- or U-shaped portion bent at right angle and rising from one or opposite ends thereof for receiving an L- or U-shaped product.

Japanese Utility Model Laid-Open Publication No. SHO-60-92918, for example, discloses a packing box of corrugated cardboard for receiving and packing an L-shaped product. The disclosed packing box comprises a single base sheet in its unfolded state. In an erected state, the base sheet has a rectangular bottom portion forming a packing portion for receiving a horizontal part of the L-shaped product, and a rectangular rear portion forming a packing portion for receiving an upright part of the L-shaped product. Plural flaps forming the horizontal part extend outwardly from the opposite sides of the bottom portion. Other flaps forming the upright part extend outwardly from opposite sides of the rear portion. Thus, the disclosed corrugated cardboard packing box does not have a sideways-long rectangular configuration when it is exploded or unfolded.

An automobile bumper has a generally flat front portion and opposite ends bent backwardly and hence is generally U-shaped. For receiving and packing such a U-shaped bumper in a corrugated cardboard box, the box is required to define a U-shaped internal space for accommodating the bumper and hence to have a U-shaped outer configuration.

Such a U-shaped packing box is known from, for example, Japanese Utility Model Laid-Open Publication No. HEI-2-48516. As shown in FIG. 2 of the publication, the disclosed packing box comprises a U-shaped container member for receiving a U-shaped product, and a U-shaped cover member for covering the container member. The container member is opened at its upper side. The cover member is opened at its lower side.

In the corrugated cardboard packing box of Japanese Utility Model Laid-Open Publication No. SHO-60-92918, the base sheet has a complex configuration and hence its cutting operation is tedious and produces wasted parts and low yielding. In addition, most part of the packing box erected by folding the base sheet is single-layered, though limited part or parts are double-layered. Consequently, when the packing box is provided in a large number and laid horizontally one over another in a stacked fashion, ones positioned at a lower level are applied with a large weight and may possibly be deformed undesirably, because they have limited vertical rigidity. For example, when the corrugated cardboard boxes containing press-shaped automobile front fenders are laid one over another in a stacked fashion, lower-leveled boxes may possibly be crushed. This directly badly affects the front fenders contained in the boxes and causes deformation of and scratches on the fenders. Thus, the number of boxes that can be stacked is limited to such extent that lower-leveled boxes are freed from undesired deformation.

Since the U-shaped packing box disclosed in Japanese Utility Model Laid-Open Publication No. HEI-2-48516 comprises two different members, namely, the container and cover members, it requires an operation for erecting the container member and another operation for erecting the cover member, thereby increasing an increased number of man a hours for erection. In addition, two different cutting-punching machines, one for cutting-punching the container member and the other for cutting-punching the cover member, are required, thereby adding up the costs of production. For making the box, it is required to first erect the container member, then to put the U-shaped product in the container member and thereafter to fit and join the cover member. Consequently, it is not possible to perform the packing operation during erection of the box.

As shown in FIGS. 4 and 5 of Japanese Utility Model Laid-Open Publication No. HEI-2-48516, the illustrated packing box includes the base sheet with flaps projecting outwardly from opposite ends thereof and hence has a generally H-shaped configuration. Accordingly, the cutting-punching operation with respect to the base sheet becomes tedious and wasted parts are produced, thereby decreasing the yielding. Before erection, base sheets of this kind are usually horizontally laid one over the other in a stacked fashion and kept in a storage space. In so doing and upon their shipment and erection, the stacked base sheets are liable to be deformed and damaged, because each base sheet has flaps sticking out to easily get caught or be hit by obstacles.

The thus-erected packing boxes are mostly single-layered. Thus, when the boxes are stacked, lower leveled ones of the boxes and the products packed therein may be easily deformed and damaged, because their vertical rigidity is weak. This is particularly so when the product is a resinous bumper.

To enable the stacked storage of the packing boxes, one may propose to increase the rigidity of the boxes by making them dual-boxed, that is, forming them by an inner box of corrugated cardboard and a rigid outer box enclosing the inner box. However, this is not advantageous in that increased production costs are required.

Further, since the boxes are still single-layered in most parts, there remains a fear that the products will be found damaged when they are taken out of the boxes. Moreover, the boxes can endure only a one-time use, or two-time use at the most, and are not suited for repeated uses.

DISCLOSURE OF THE INVENTION

It is therefore an object of the present invention to provide an L- or U-shaped packing box which is formed by folding a single sheet of corrugated cardboard such that an automobile L-shaped front fender or U-shaped bumper can be received and packed, and which can endure stacked storage and allows for repeated uses.

According to an aspect of the present invention, there is provided a packing box for packing a product having at least one bent portion, the packing box being erected by folding a single sideways-long rectangular base sheet along folding to lines and slits formed on the base sheet such that the product including the bent portion is entirely covered, characterized in that the base sheet comprises: a first folding line discontinuously extending longitudinally of the base sheet; a second folding line continuously extending longitudinally of the base sheet in parallel with the first folding line for, together with the first folding line, dividing the base sheet into three laterally separated regions, the three regions including opposed outer regions and a central region positioned therebetween; a plurality of first short slits provided on one of the outer regions such that they extend from a long side of the one outer region to the second folding line; a plurality of second short slits provided on the other one of the outer regions such that they extend from a long side of the other outer region to the first folding line; a plurality of long slits provided on the other outer region such that they extend from the long side of the other outer region to the second folding line; a plurality of third folding lines provided on the one outer region such that they extend from the long side of the one outer region to the second folding line in axially aligned relation to the long slits; a plurality of fourth folding lines provided on the central region such that they extend between the first and second folding lines in axially aligned relation to the first and second short slits; and a plurality of flaps defined by the first and second folding lines, the third and fourth folding lines, the first and second short slits, and the long slits, so that the base sheet can be folded along the third and fourth folding lines and the slits into a tubular shape and then into the packing box having at least one bent portion by folding at least part of the tubular-shaped base sheet with relative to another part of the tubular-shaped base sheet.

In the thus arranged packing box, since the packing material comprises a single sideways-long rectangular base sheet which is simple in configuration, its cutting operation becomes easy and wasted parts can be kept to a minimum, thereby achieving high yielding. Further, since the base sheet is of non-complex rectangular configuration, folding lines and slits can be easily formed on the sheet. When a plurality of such base sheets are laid one over the other in a stacked fashion, they will not be damaged, because they are of simple rectangular configuration with no parts sticking out. They will not be damaged upon shipment, either.

By folding part of the base sheet along the long slits, a box-shaped upright portion is provided for enclosing the bent portion of the product. The first and second folding lines, the third and fourth folding lines, the short slits and the long slits are all formed transversely and longitudinally on the base sheet so that the flaps defined by them have no parts projecting outwardly. In addition, an apparatus for forming those folding lines may be simple in construction.

Desirably, the packing box has at least two-layered wall portions so that it can endure a vertical load applied when the box is positioned at a lower level of a stack of such boxes. The base sheet may be folded such that wall portions of the box to which a large load is applied become three-layered and most wall portions of the box become two-layered. Consequently, the erected packing box has increased rigidity. Thus, there is no fear that the box with the product packed therein will be deformed when it is positioned at a lower level of a stack of such boxes, thereby enabling reuse of the box and hence reduction in the costs thereof.

In a preferred form, the packing box comprises a box-shaped body portion erected by folding the base sheet along the folding lines and the slits, and a box-shaped upright portion integral with and rising at right angle from at least one end of the body portion.

It is desirable that the packing box has an L-shaped configuration so that it can pack an L-shaped product. The L-shaped product may be an automobile front fender. It is also desirable that the packing box has a U- or channel-shaped configuration so that it can pack a U- or channel-shaped product. The U-shaped product may be an automobile bumper.

In a preferred form, the base sheet comprises a sheet of corrugated cardboard. The base sheet may be made from a water-, humidity- and wear-resistant material.

The first folding line may comprise six line segments occurring intermittently along the length of the base sheet. The second folding line may comprise six line segments occurring continuously along the length of the base sheet. The separate folding line provided on the central region may comprise four folding lines. The separate folding lines provided on the either outer side region may comprise two folding lines. The short slits provided on the either outer side region may comprise three short slits. The short slits provided on the other outer side region may comprise seven short slits. The long slits may comprise two slits extending from a long side of the other outer side region to the second folding line. The either outer side region may comprise six flaps defined by the second folding line, the two folding lines provided thereon and the three short slits provided thereon. The other outer side region may comprise ten flaps defined by the first folding line, the seven short slits provided thereon and the two long slits provided thereon. The central region may comprise six flaps defined by the first and second folding lines, the four folding lines provided thereon and the two long slits.

The first folding line may comprise eight line segments occurring intermittently along the length of the base sheet. The second folding line may comprise eight line segments occurring continuously along the length of the base sheet. The folding lines provided on the central region may comprise four folding lines. The folding lines provided on the either outer side region may comprise four folding lines. The short slits provided on the either outer side region may comprise three slits. The short slits provided on the other outer side region may comprise eleven slits. The long slits may comprise four slits extending from a long side of the other outer side region to the second folding line. The either outer side region may comprise eight flaps defined by the second folding line, the four folding lines provided thereon and the three slits provided thereon. The other outer side region may comprise sixteen flaps defined by the first folding line, the eleven short slits provided thereon and the four long slits. The central region may comprise eight flaps defined by the first and second folding lines, the four folding lines provided thereon and the four long slits.

BRIEF DESCRIPTION OF THE DRAWINGS

Certain preferred embodiments of the present invention will hereinafter be described in detail, by way of example only, with reference to the accompanying drawings, in which.

BEST MODE FOR CARRYING OUT THE INVENTION

The following description is merely exemplary in nature and is in no way intended to limit the invention or its application or uses.

With reference to FIGS. 1 to 13, discussion will be made first as to an L-shaped packing box according to a first embodiment of the present invention.

Figure 1:
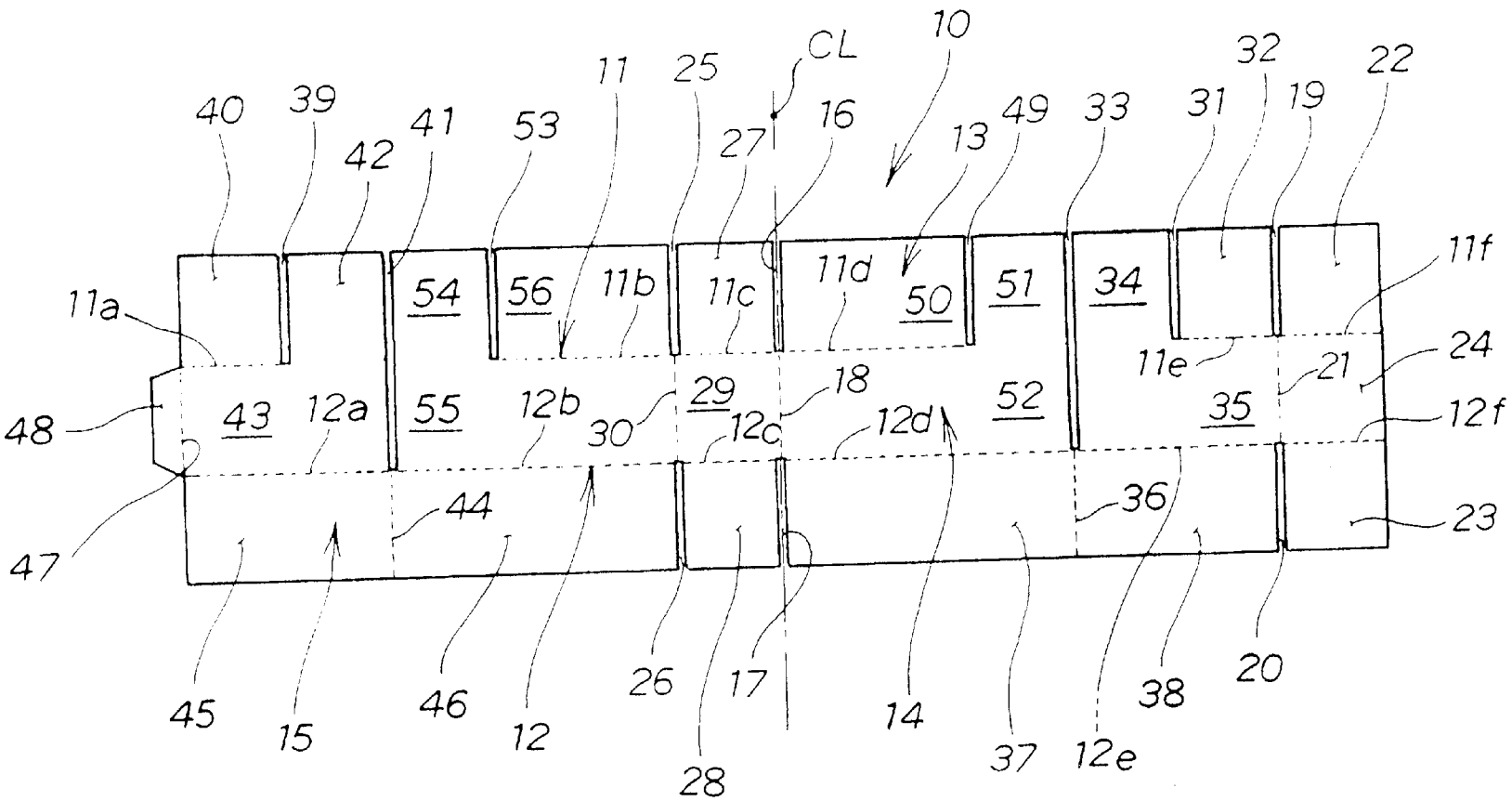
FIG. 1 illustrates a base sheet for being folded into an L-shaped packing box according to a first embodiment of the present invention.

Referring to FIG. 1, a base sheet 10, designed for packing an L-shaped product such as an automobile front fender, is shown in an unfolded state. The base sheet 10 is formed by cutting a single rectangular corrugated cardboard into a predetermined length, followed by punching the cut length into a desired shape. The base sheet 10 may be a sheet of corrugated cardboard which comprises a corrugated sheet of paper with a cardboard stuck to one or both sides thereof. Otherwise, the base sheet 10 may be a sheet of corrugated cardboard made from a material infiltrated or coated with a resin so as to be water-, humidity- and wear-resistant, or a water-repellent corrugated cardboard, or a sheet of synthetic resin.

The base sheet 10 includes first and second folding lines 11, 12 which divides short sides (vertical direction in the figure) of the sheet into three. The first and second folding lines 11, 12 are provided longitudinally of the base sheet 10 and divides the sheet 10 into an upper region 13, a central region 14 and a lower region 15.

The term "folding line" used herein, though indicated by a dotted line in the figure for clarity, should be construed as representing any linear portion which is weakened or recessed to initiate the folding of the illustrated product therealong. The same applies to all folding lines discussed herein.

The first folding line 11, formed at a boundary between the upper region 13 and the central region 14, comprises line segments intermittently occurring along the length of the base sheet 10. The second folding line 12, formed at a boundary between the central region 14 and the lower region 15, comprises line segments occurring continuously along the length of the base sheet 10.

More specifically, the first folding line 11 comprises six line segments referenced by numerals 11*a*, 11*b*, 11*c*, 11*d*, 11*e* and 11*f*. Similarly, the second folding line 12 comprises line segments referenced by numerals 12*a*, 12*b*, 12*c*, 12*d*, 12*e* and 12*f*.

The base sheet 10 includes a plurality of flaps provided on both sides of a lateral center line CL perpendicular to the first and second folding lines 11, 12. A slit 16 extends from an upper long side of the base sheet 10 to the first folding line 11, while a slit 17 extends from a lower long side of the base sheet 10 to the second folding line 12. These slits 16, 17 are in alignment with the center line CL. Between the slits 16, 17, the central region 14 has a folding line 18 in alignment with the axis of the slits 16, 17.

The upper region 13 has a slit 19 provided a given distance away from the right short side of the base sheet 10 and extending perpendicularly to the length of the sheet 10 from the upper long side to the folding line 11*f*. Similarly, the lower region 15 has a slit 20 provided a given distance away from the right short side and extending perpendicularly to the length of the sheet 10 from the lower long side portion to the folding line 12*f*. The central region 14 has a folding line 21 provided between the slits 19 and 20. The upper region 13 has an upper flap 22 of small width defined by the folding line 11*f* and the slit 19. Similarly, the lower region 15 has a lower flap 23 of small width defined by the folding line 12*g* and the slit 20. The central region 14 has a central flap 24 of small width surrounded by the folding lines 11*f*, 12*f* and 21.

On the left side of the center line CL of the base sheet 10, short slits 25, 26 extend from the respective upper and lower long sides to the respective folding lines 11*c*, 12*c*. An upper flap 27 of small width is defined jointly by the line segment 11*c* and the slits 16, 25. Similarly, a lower flap 28 of small width is defined jointly by the line segment 12*c* and the slits 17, 26. A central flap 29 of small width is provided between the upper and lower flaps 27, 28.

Between the slits 25, 26, a folding line 30 extends along the axis of the slits 25, 26.

On the left side of the flaps 22, 23. provided at a right end portion of the base sheet 10, a short slit 31 is provided a given distance away from the slit 19 to extend from the upper long side to the folding line 11*e*. A short upper flap 32 is defined jointly by the slits 19, 31 and the folding line 11*e*.

A long slit 33 is provided on the left side of the flap 32 to extend from the upper long side to the second folding line 12. The upper region 13 includes an upper flap 34 defined by the short slit 31 and the long slit 33. The central region 14 includes a long central flap 35 contiguous with the upper flap 34. The upper flap 34 and the central flap 35 are continuing to provide an L-shaped configuration with no folding line provided therebetween.

The lower region 15 has a folding line 36 extending from the lower long side to a lower end of the long slit 33. A lower flap 38 is surrounded by the folding line 36, short slit 20 and folding line 12*e*. Continuing with the lower flap 38 is a large lower flap 37 surrounded by the folding line 36, slit 17 and folding line 12*d*.

On the left side, the upper region 13 has a short slit 39 which extends from the upper long side to the folding line 11*a*. The slit 39 and the folding line 11*a* defines an upper flap 40. on a right side of the slit 39, a long slit 41 is provide d to e extend from the upper long side to the second folding line 12. Formed between the short slit 39 and the long slit 41 is an upper flap 42. The central region 14 has at a left end thereof a central flap 43 contiguous with the upper flap 42. The upper flap 42 and the central flap 43 are continuing g in such a manner as to provide a reverse L-shaped configuration with no folding line formed therebetween.

The lower region 15 has a folding line 44 provided between the lower long side and the long slit 41. By the folding line 44 and the folding line 12*a*, a lower flap 45 is defined. Next to the lower flap 45, a large lower flap 46 is defined by the slit 26 and the folding lines 12*b*, 44.

On the left end portion, the central flap 43 has a joining flap 48 foldable at a folding line 47.

Provide d leftwardly of the long slit 33 is a short slit 49 extending from the upper long side to the folding line 11*d*. The upper region 13 has an upper flap 50 surrounded by the slit 49, the slit 16 aligned with the center line CL, and the folding line 11*d*. A short upper flap 51 is formed between the long slit 33 and the short slit 49. The central region 14 includes a central flap 52 defined by the folding lines 11*d*, 12*d*, the folding line 18, and the long slit 33. The upper flap 51 and the central flap 52 are integral with each other to provide a reverse L-shaped configuration with no folding line provided therebetween.

Rightwardly of the long slit 41, a slit 53 is provided to extend from the upper side of the upper region 13 to the folding line 11*b* which is part of the first folding line 11. Between the slit 53 and the slit 41, an upper flap 54 is provided. The central region 14 has a central flap 55 defined by the folding line 11*b*, the folding line 12*b* which is part of the second folding line 12, the long slit 41 and the folding line 30 provided between the slits 25, 26. The upper flap 54 and the central flap 55 are joined together to provide an L-shaped configuration with no folding line provided therebetween. The upper region 13 has an upper flap 56 surrounded by the slit 53, the slit 25 and the folding line 11*b*.

As explained above, the base sheet 10 is obtained by cutting a single sheet of corrugated cardboard into a given length of rectangular configuration long sideways and includes plural slits 16, 17, 19, 20, 31, 33, 25, 26, 39, 41, 49, 53, all running perpendicularly to a longitudinal direction thereof, and the first and second folding lines 11, 12 extending along the length thereof. In other words, the base sheet for forming the corrugated cardboard box according to the present invention can be obtained by just cutting a single sheet of corrugated cardboard into a sideways-long rectangular configuration and then providing the cut configuration with the aforementioned slits and folding lines.

Figure 2:
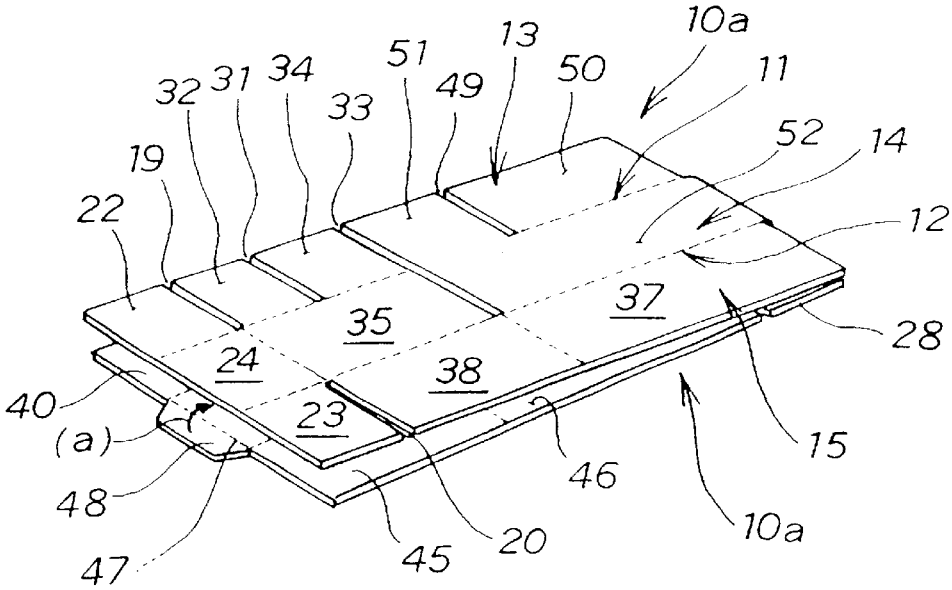
FIG. 2 is a perspective view illustrating the base sheet of FIG. 1 folded in two.

Reference is now made to FIG. 2 showing in perspective the base sheet 10 of FIG. 1 folded in two.

As shown in FIG. 2, the base sheet 10 can be folded over along the folding line 18 aligned with the center line CL shown in FIG. 1. By virtue of the slits 16, 17 aligned with the folding line 18, the base sheet 10 can be readily folded in two. After the base sheet 10 is thus folded in two, the joining flap 48 is folded along the folding line 47, as indicated by arrow (a), and then tucked under the central flap 24. The thus-folded base sheet 10*a* is sized to provide easy storage and shipment thereof.

Figure 3:
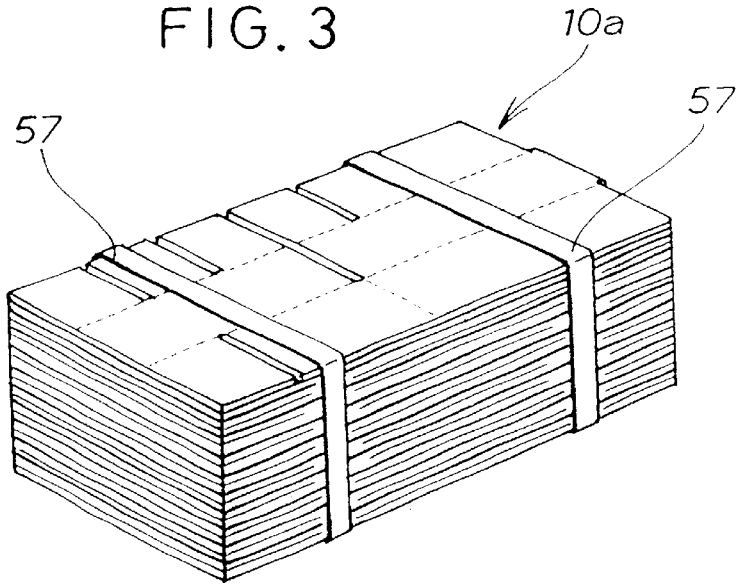
FIG. 3 is a perspective view illustrating a stack of base sheets folded in two as shown in FIG. 2 and laid in a horizontal orientation one over another.

Turning now to FIG. 3, a plurality of doubled base sheets 10*a* can be laid one over another neatly as illustrated. When the base sheet 10 is folded in two, the long slit 33 and the slit 41 are displaced from each other, thereby maintaining rigidity of the doubled base sheet 10*a*. The doubled base sheets 10*a* laid one over another are bound together by belts 57, 57 into a single stack.

Discussion will be made next as to an operation for folding the above-described base sheet 10 into a packing box with reference to FIGS. 4 to 10.

Figure 4:
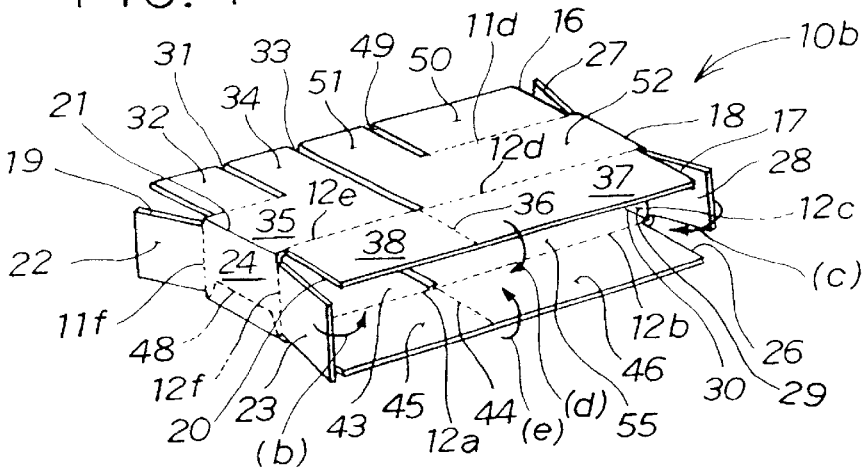
FIG. 4 is a perspective view illustrating a first stage of an operation for erecting the L-shaped packing box.

As shown in FIG. 4, the central flap 29 of the doubled base sheet 10*a* of FIG. 2 is folded upwardly along the folding line 30, whereafter the central flap 24 of the doubled base sheet 10*a* is folded downwardly along the folding line 21. As a result, the central flap 24 is brought into an opposed relation to the central flap 29. Then, the joining flap 48 is connected by means of an adhesive or a sticky tape to an inner surface of the central flap 24, thereby turning the doubled base sheet 10*a* in a flattened state as shown in FIG. 2 into a rectangular frame structure opening at upper and lower sides thereof, as shown in FIG. 4.

Figure 5:
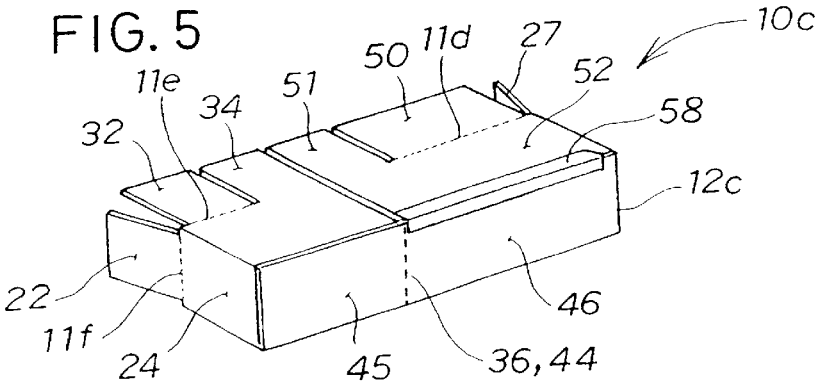
FIG. 5 is a perspective view illustrating a second stage of the operation for erecting the L-shaped packing box.

Continuously, the flaps 23, 28 are folded inwardly of the frame structure 10*b* along the respective folding lines 12*f*, 12*c*, as indicated by arrows (b), (c). The flaps 37, 38 are then folded inwardly of the frame structure 10*b* along the folding lines 12*d*, 12*e*, as indicated by arrow (d). Subsequently, the flaps 45, 46 are folded inwardly of the frame structure 10*b* along the respective folding lines 12*a*, 12*b* as indicated by arrow (e) such that the flaps 45, 46 are laid over an upper or outer surface of the flaps 37, 38. An edge portion of the flap 46 is then connected with a mated edge portion of the upwardly-positioned central flap 52 via an adhesive tape 58 to thereby provide an upwardly-opened, horizontally-long rectangular box 10*c* is provided as shown in FIG. 5.

The thus-built box 10*c* includes a bottom having a threefold part formed by the flaps 23, 38, 45. laid one over the other and a threefold part formed by the flaps 28, 37, 46 laid one over the other. Consequently, the box 10*c* is rendered rigid at bottom corners thereof. In addition, major part of the bottom of the box 10*c* is of twofold structure formed by the flaps 37, 46 laid one over another.

Figure 6:
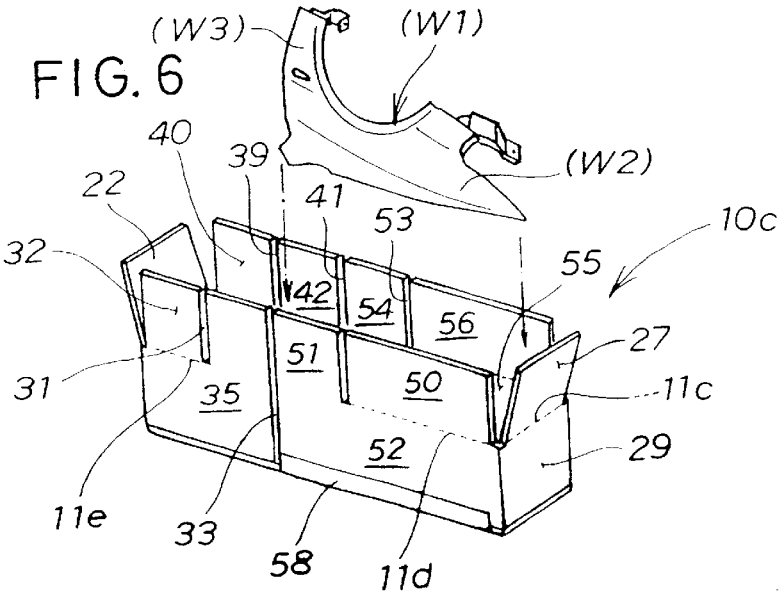
FIG. 6 is a perspective view illustrating the partly-erected sideways-long packing box, in conjunction with an automobile front fender as the L-shaped product being received in the box.

Reference is made next t o FIG. 6 showing the upwardly-opened box 10*c* placed upright with the flaps 45, 46 positioned at the bottom, in conjunction with an automobile front fender as an L-shaped resinous product W1 to be packed in the box structure.

Front fender W1 is inserted from above into a space defined between the long slits 33, 41 and the end flap 29 and between the central flaps 52, 55. In other words, the fender W1 is not received in a space between the flap 35 and the flap 43 (see FIG. 1) opposed to the flap 35.

Figure 7:
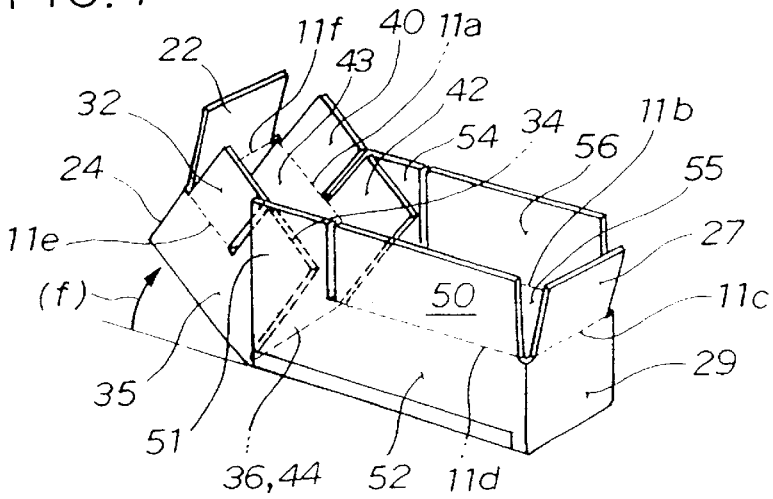
FIG. 7 is a perspective view illustrating a third stage of the operation for erecting the packing box wherein the box is folded into an L-shape.

Reference is made next to FIG. 7 illustrating a manner of folding the box 10*c* of FIG. 6 into an L-shaped box structure, with the front fender W1 omitted for clarity.

As described above, the flaps 37, 38, 45, 46 (see FIG. 4) for forming the bottom of the box 10*c* have the folding lines 36, 44 positioned between the opposed long slits 33, 41 (see FIG. 6). The flaps 35, 43 are bent 90 degrees about the folding lines 36, 44 as indicated by arrow (f) in FIG. 7. As a result, the flaps 35, 43 are placed in an upright position and take an L-shaped posture with respect to the flaps 52, 55 on both sides of the box 10*c*, with the end flap 24 placed on an upper surface of the box 10*c*.

As shown in FIG. 7, the flaps 34, 42 are laid on inner sides of the flaps 52, 55 forming side walls of the box 10*c*. The flap 35 lies on inner sides of the flaps 51 and 55 while the 43 lies on inner sides of the flaps 54 and 55.

Figure 8:
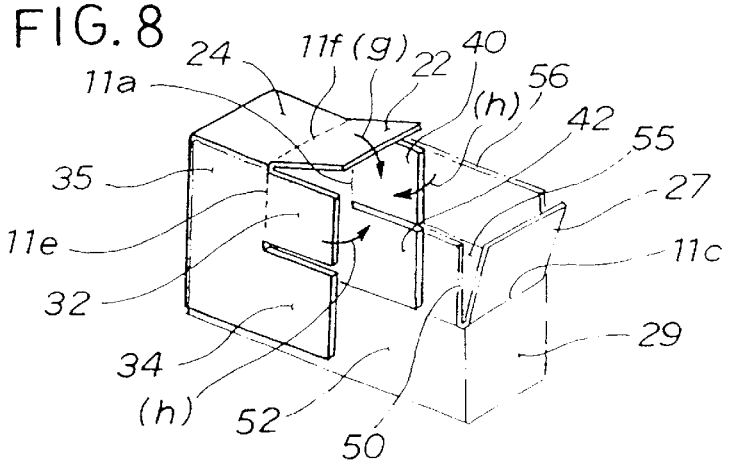
FIG. 8 is a perspective view illustrating a fourth stage of the operation for erecting the packing box wherein the box of FIG. 7 is made into an L-shape by folding an end thereof.
Figure 9:
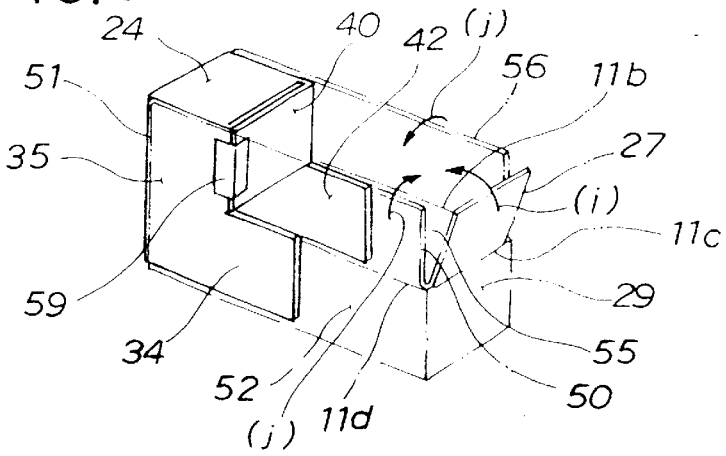
FIG. 9 is a perspective view illustrating a final stage of the operation for erecting the box.

In FIG. 8, the front fender storage portion shown in FIG. 7 is indicated by a double-dot-and-dash line for clarity while the L-shaped portion is indicated by a solid line. After the flap 22 is folded downwardly along the folding line 11*f* as shown by arrow (g), the flaps 32, 40 are folded inwardly along the folding lines 11*e*, 11*a* onto the flap 22 so that the inside of the L-shaped portion becomes triple-layered with the flaps 22, 32, 40. Inner edge portion of the flap 35 forming the side of the L-shaped portion and a mated edge portion of the flap 40 are connected together by means of an adhesive tape 59, as shown in FIG. 9.

Figure 10:
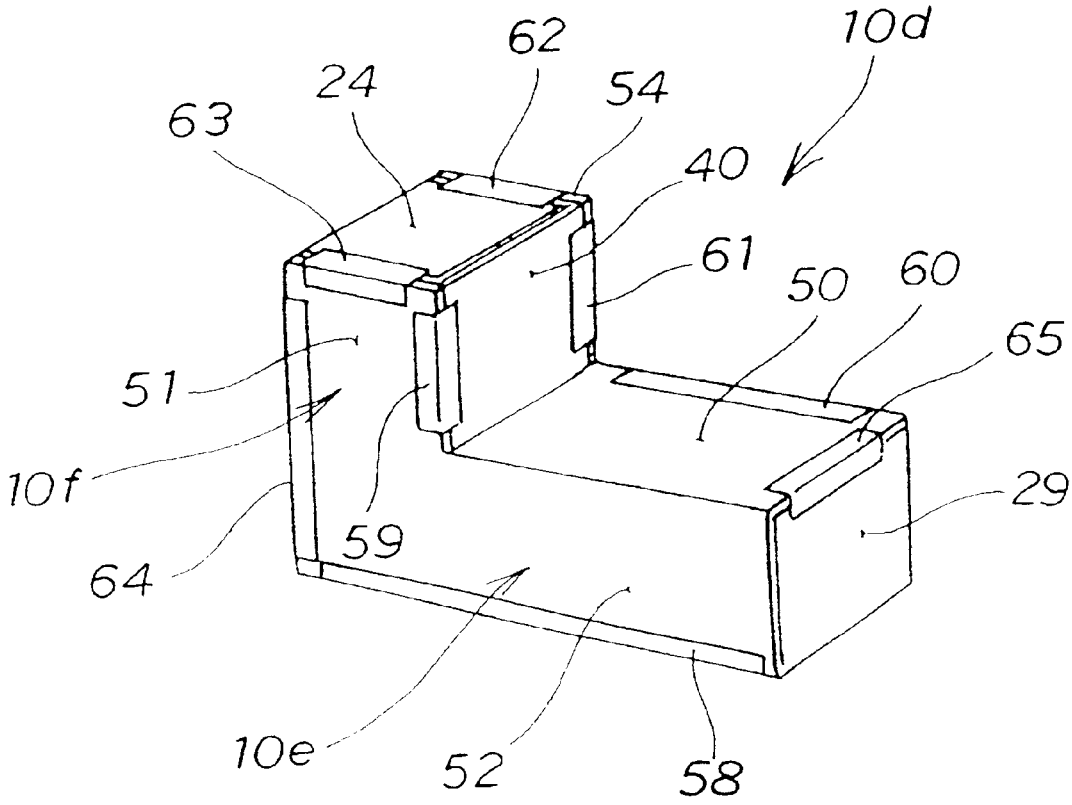
FIG. 10 is a perspective view illustrating an appearance of the erected L-shaped packing box.

Continuously, the flap 27 is folded inwardly along the folding line 11*c* as shown by arrow (i). Then, the long flap 56 is folded inwardly, whereafter the long flap 50 opposed to the flap 56 is folded inwardly onto the flap 56 as shown by arrows (j), (j). These flaps 56, 50 are laid one over the other and connected together by means of an adhesive tape 60, thereby providing an L-shaped packing box 10*d* as shown in FIG. 10. The portion where the flap 27 has increased rigidity, because it is three-layered with the flaps 27, 56 and 50. Part other than that where the flap 27 is located is two-layered with the flaps 56, 50.

Turning now to FIG. 10, the thus-obtained L-shaped corrugated cardboard packing box 10*d* is applied with adhesive tapes 61, 62, 63, 64, 65 at each corner thereof to thereby increasing its overall rigidity. The packing box 10*d* comprises a body portion 10*e* and a box-shaped upright portion 10*f* bent at right angle and rising from one end of the body portion 10*e*.

Figure 11:
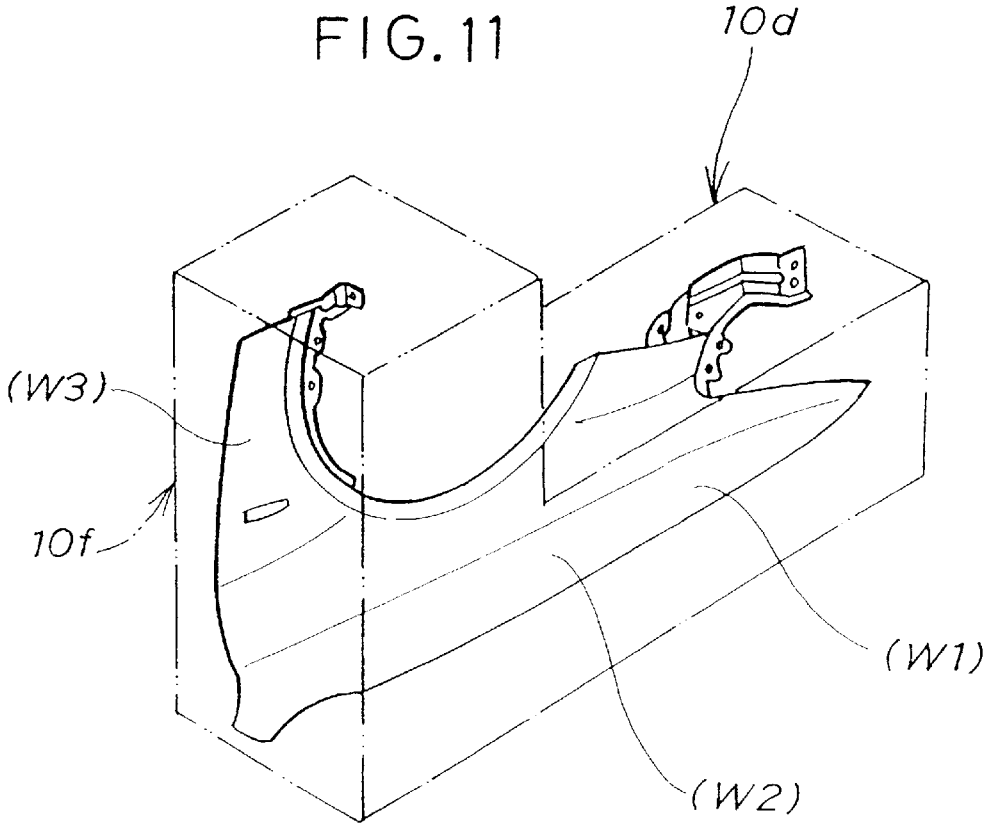
FIG. 11 is a perspective view illustrating the L-shaped packing box with the front fender as the L-shaped product packed therein.

In FIG. 11, the packing box 10*d* is indicated by a two-dot-and-dash line so that the L-shaped resinous product (automobile front fender) received and packed in the L-shaped packing box 10*d* can be readily appreciated.

In the first embodiment, since the article to be packed is the front fender W1, it is fitted in the packing box 10*d* upside down. That is, the front fender W1 is received in the box 10*d* such that a sideways-long bonnet side portion W2 is positioned underside with a downwardly-projecting rear portion W3 placed in the upright portion 10*f*.

Figure 12:
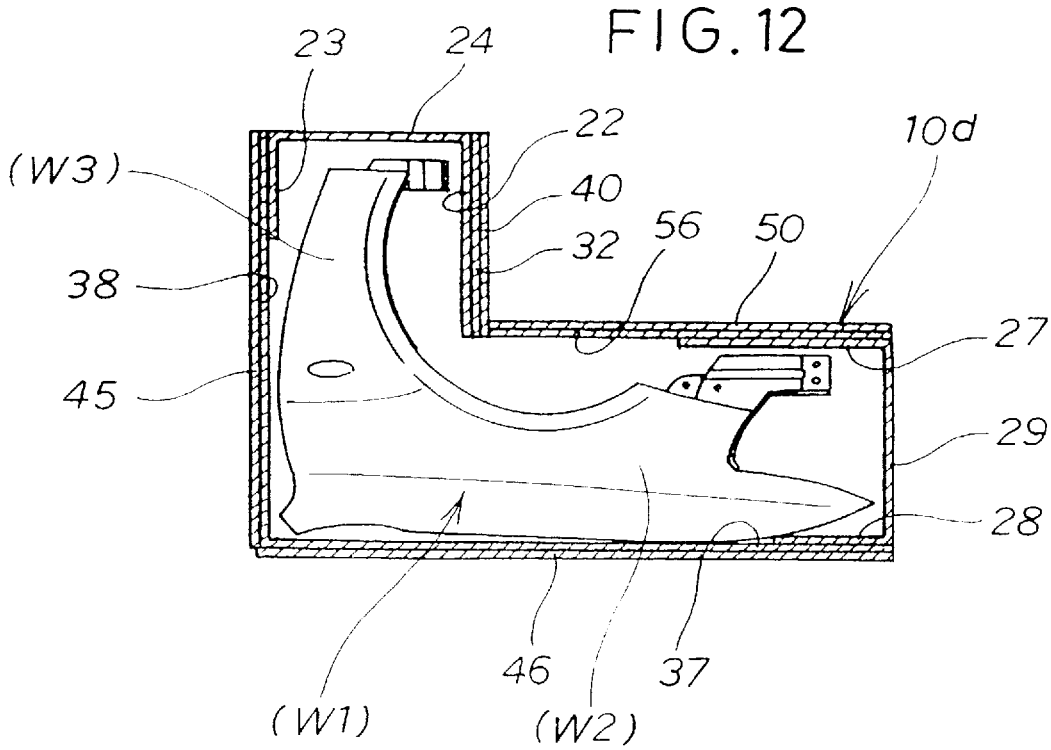
FIG. 12 is a cross-sectional view taken vertically centrally of the erected L-shaped packing box.

As can be appreciated from FIG. 12, outer side of the upright L-shaped portion is dual-layered with the flaps 38, 45 while the inner side of the L-shaped portion is three-layered with the flaps 22, 32, 40. The bottom of the box has a dual structure formed by the flaps 37, 46. Part of an upper side of the box body is three-layered with the flaps 27, 50, 56 while other part of the upper side of the box body is two-layered with the flaps 50, 56.

Figure 13:
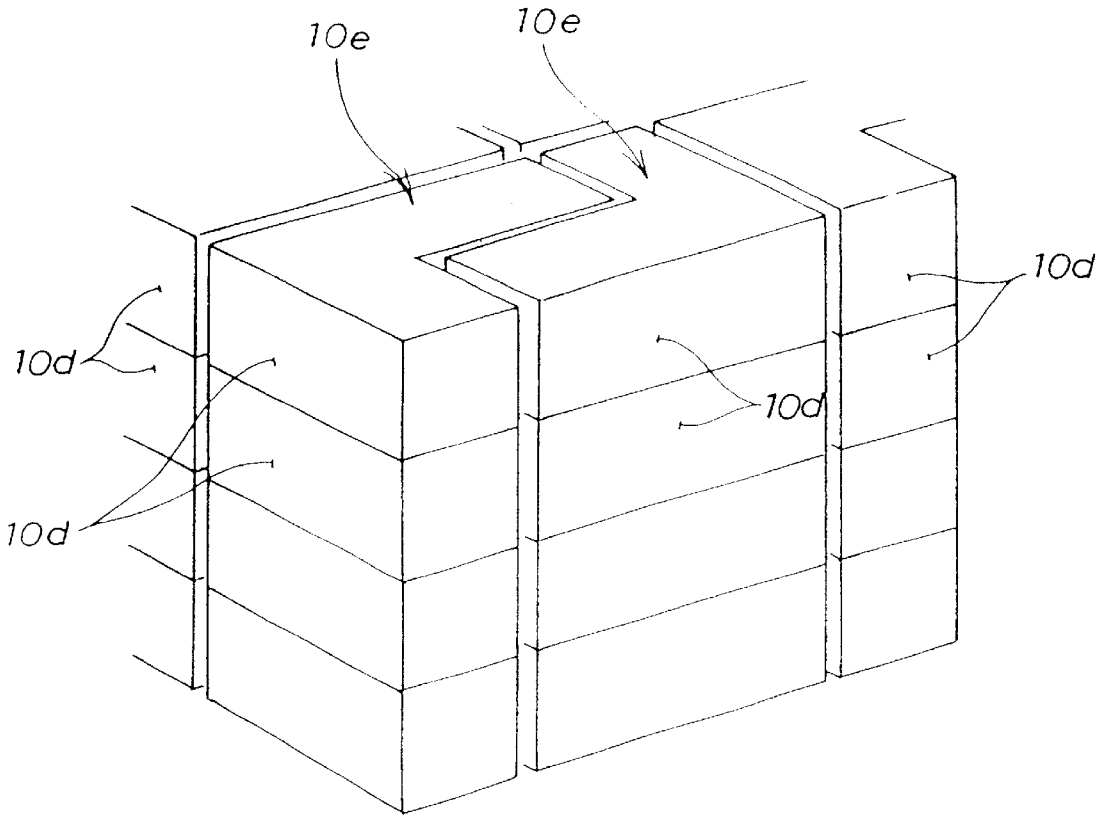
FIG. 13 is a perspective view illustrating grouped stacks of L-shaped packing boxes containing the L-shaped product packed therein and laid one over another in a horizontal orientation, adjacent two groups being mated together at their L-shaped sides.

A multitude of L-shaped packing boxes 10*d* with cast products packed therein can be piled up in groups 10*e* as shown in FIG. 13. Each group 10*e* is mated with an adjacent group 10*e* at their L-shaped sides to thereby save space for storage.

As explained above, since the base sheet 10 for forming the L-shaped packing box 10*d* according to the first embodiment is of simple sideways-long rectangular configuration, no part is wasted when the base sheet 10 is cut into a rectangle of predetermined length, thereby achieving high yielding. Further, forming of the base sheet 10 becomes easy, because the base sheet 10 has lengthwise folding lines separating the base sheet into three longitudinally extending regions and plural slits extending perpendicularly to the folding lines, thereby providing plural flaps foldable along the folding lines and slits.

Since the base sheet 10 is foldable about the center line CL running normal to the length thereof, the sheet 10 can be reduced to half in its length. When folded in two, the base sheet 10 has no parts projecting outwardly and hence is not bulky. Consequently, the base sheet 10 can be conveniently piled and bundled for storage and has no fear of being damaged by its flaps being hooked.

Most parts of the obtained L-shaped corrugated cardboard packing box is two-layered. Particularly, rigidity-requiring part of the box is three-layered. Thus, when a multiplicity of such boxes are piled up, there is no fear that they will be undesirably deformed and damaged, thereby enabling reuse thereof.

Discussion will be made next as to a packing box, designed for packing a U-shaped product such as an automobile bumper, according to a second embodiment of the present invention, with reference to FIGS. 14 through 25.

Figure 14:
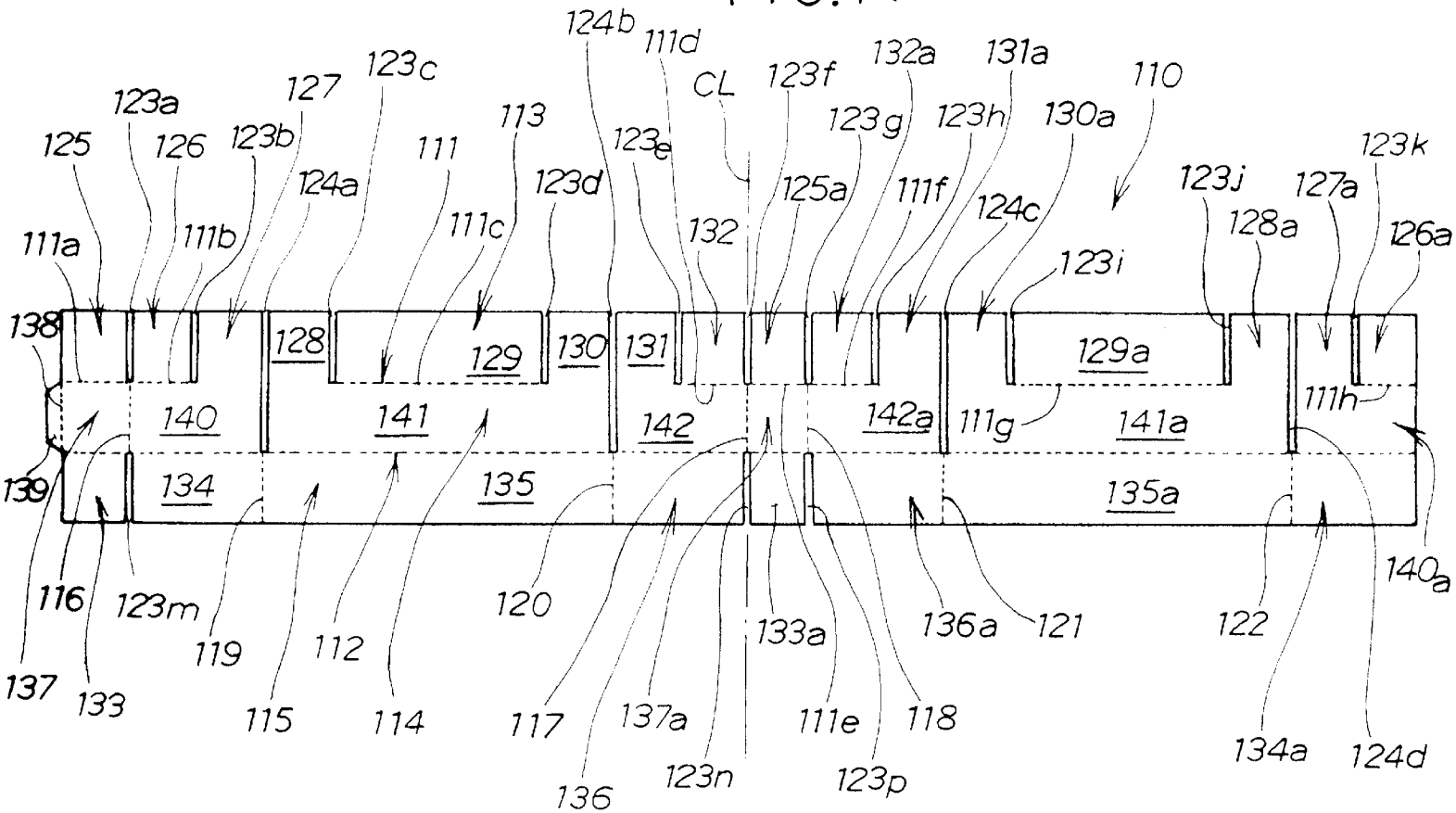
FIG. 14 illustrates a base sheet for being folded into a U-shaped packing box according to a second embodiment of the present invention.

In FIG. 14, a base sheet 110, designed for packing a U-shaped product such as an automobile bumper, is shown in its unfolded state. The base sheet 110 is formed by cutting a single sheet of corrugated cardboard into a predetermined length, followed by punching the cut length into a desired shape. As in the first embodiment, the base sheet 110 may be a sheet of corrugated cardboard which comprises a corrugated sheet of paper with a cardboard stuck to one or both sides thereof. Otherwise, the base sheet 110 may be a sheet of corrugated cardboard made from a material infiltrated or coated with a resin so as to be water-, humidity- and wear-resistant, or a water-repellent corrugated cardboard, or a sheet of synthetic resin.

The base sheet 110 has first and second folding lines 111, 112 running longitudinally thereof to divide the sheet into three longitudinally extending regions, namely, an upper region 113, a central region 114 and a lower region 115.

The first folding line 111 provided at a boundary between the central region 114 and the upper region 113 occurs intermittently along the length of the sheet 110. The second folding line 112 provided at a boundary between the central region 114 and the lower region 115 runs continuously along the length of the sheet 110.

For convenience upon description of the first folding line in conjunction with flaps below, line segments forming the first folding line 111 are referenced 111*a*, 11*b*, 111*c*, 111*d*, 111*f*, 111*g* and 111*h*.

The central region 114 has folding lines 116, 117, 118 running transversely of the sheet 110. The lower region 115 has folding lines 119, 120, 121, 122 running transversely of the sheet 110.

Slits are also provided to extend laterally of the base sheet 110.

The upper region 113 is provided with eleven short slits 123*a*, 123*b*, 123*c*, 123*d*, 123*e*, 123*f*, 123*g*, 123*h*, 123*i*, 123*j*, 123*k* extending from an upper long side of the base sheet 110 to the first folding line 111. Similarly, the lower region 115 is provided with three short slits 123*m*, 123*n*, 123*p* extending from a lower long side of the base sheet 110 to the second folding line 112.

The upper and central regions 113, 114 are also provided with four long slits 124*a*, 124*b*, 124*c*, 124*d* extending from the upper long side of the base sheet 110 to the second folding line 112.

At a left end portion, the upper region 113 has a small rectangular flap 125 defined by the slit 123*a* and the folding line 111*a*. A flap 125*a* opposed to the flap 125 as the base sheet 110 is built up is defined on a right side of the center line CL by the slits 123*f*, 123*g* and folding line 111*e*.

On a right side of the flap 125, a small flap 126 is defined by the slits 123*a*, 123*b* and folding line 111*b*. At a right end portion of the base sheet 110, there is provided a flap 126*a* which is defined by the short slit 123*k* and folding line 111*h* and opposed to the flap 126 when the base sheet 110 is built up. On a right side of the flap 126, a small flap 127 is provided with no folding line running between the short slit 123*b* and the long slit 124*a*. On a left side of the 126*a*, a flap 127*a* is provided between the short slit 123*k* and the long slit 124*d*. The flap 127*a* is brought into an opposed relation to the flap 127 when the base sheet 110 is built up.

Between the long slit 124*a* on the right side of the flap 127 and the short slit 123*c*, a small flap 128 with no folding line is provided. Next to the flap 128 on a right side thereof, a sideways-long flap 129 is provided which is divided by the short slit 123*c*, slit 123*d* and the folding line 111*c*. A flap 130 with no folding line is provided between the short slit 123*d* and the long slit 124*b*. Flap 128*a* with no folding line is defined on a left side of the flap 127*a* provided on the right end portion of the Upper region 113 between the long slit 124*d* and the short slit 123*j*. On a left side of the flap 128*a*, there is provided a long flap 129*a* which is surrounded by the short slits 123*j*, 123*i* and the folding line 111*g*. On a left side of the flap 129*a*, a small flap 130*a* with no folding line is provided between the short slit 123*i* and the long slit 124*c*. The flaps 128*a*, 129*a*, 130*a* are opposed to the flaps 128, 129, 130, respectively, when the base sheet 110 is built up.

On a right side of the flap 130, a small flap 131 with no folding line is provided which is positioned between the long slit 124*b* and the short slit 123*e*. A flap 131*a* with no folding line is provided on a left side of the flap 130*a* such that it faces the flap 131 as the base sheet 110 is erected.

Flap 132 is defined on a right side of the flap 131 by the short slits 123*e*, 123*f* and the folding line 111*d*. A flap 132*a* is defined on a right side of the flap 131*a* by the slits 123*g*, 123*f* and the folding line 11*f*, and opposed to the flap 132 as the base sheet 110 is placed in an erected state.

The lower region 115 has eight flaps 133, 134, 135, 136, 133*a*, 136*a*, 125*a* and 134*a*.

Small flap 133 is divided by the short slit 123*m* and the folding line 112. A flap 133*a* is defined by the short slits 123*n*, 123*p* and the second folding line 112, and is opposed to the flap 133 upon erection of the base sheet 110.

The lower region 115 has the folding line 119 aligned with the long slit 124*a*, folding line 120 aligned with the long slit 124*b*, folding line 121 aligned with the long slit 124*c*, and the folding line 122 aligned with the long slit 124*d*.

Flap 134 is divided by the slit 123*m*, folding line 119 and the second folding line 112. The flap 135 continuing with the flap 134 is surrounded by the folding lines 119, 112 and 120. The flap 136 continues from the flap 135 and is surrounded by the folding lines 120, 112 and the slit 123*n*.

Flap 134*a* is surrounded by the folding lines 112, 122 and opposed to the flap 134 upon erection of the base sheet 110. A flap 135*a* adjoining the flap 134*a* is surrounded by the folding lines 112, 121, 122 and opposed to the flap 135 upon erection of the base sheet 110. The flap 136*a* is surrounded by the folding lines 112, 121 and the slit 123*p*, and opposed to the flap 136 upon erection of the base sheet 110.

Discussion will be made next as to the flaps of the central region 114.

The central region 114 has eight flaps referenced 137, 140, 141, 142, 137*a*, 142*a*, 141*a*, 140*a* from the left to the right ends.

Leftmost flap 137 has at a left end thereof a joining flap 139 defined by a folding line 138 parallel to the folding line 116. The flap 137 is surrounded by the folding lines 111*a*, 116, 112 and 138. The flap 137*a* is surrounded by the folding lines 111*e*, 112, 117 and 118, and opposed to the flap 137 upon erection of the base sheet 110.

On a right side of the flap 137, the flap 140 is provided between the folding line 116 and the slit 124*a*. The flap 140 is continuing with the flap 127 of the upper region 113 with no folding line therebetween, and has an inverted-L-shaped configuration. The flap 140*a* is continuing with the flap 127*a* of the upper region 113 and has an L-shaped configuration. The flap 140*a* is opposed to the flap 140 when the base sheet 110 is placed in an erected state.

Flap 141 is surrounded by the long slit 124*a*, 124*b* and the folding lines 112, 111*c*. The flap 141 continues on both sides with the flaps 128, 130 of the upper region 113 with no folding lines provided therebetween. The flap 141*a* is surrounded by the long slits 124*c*, 124*d* and the folding lines 111*g*, 112. Similarly to the flap 141, the flap 141*a* is continuing on both sides with the flaps 128*a*, 130*a* with no folding lines provided therebetween, and is opposed to the flap 141 when the base sheet 110 is placed in an erected state.

Flap 142 is surrounded by the long slit 124*b* and the folding lines 117, 111*d*, 112. The flap 142 continues with the flap 131 of the upper region 112 with no folding line provided therebetween. The flap 142*a* is surrounded by the long slit 124*c* and the folding lines 111*f*, 112, 118. The flap 142*a* continues with the flap 131*a* of the upper region 113 with no folding line provided therebetween and has an inverted-L-shaped configuration. Further, the flap 142*a* is opposed to the flap 142 upon erection of the base sheet 110.

Discussion will be made next as to a operation for folding the base sheet 110 into a U-shaped packing box of corrugated cardboard.

Figure 15:
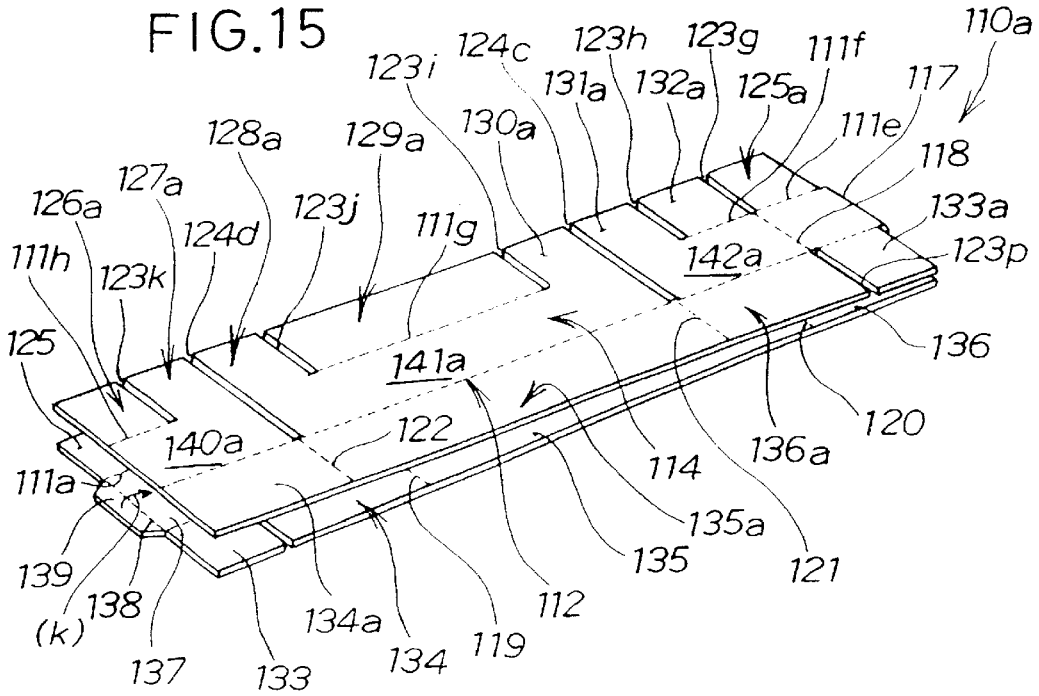
FIG. 15 is a perspective view illustrating the base sheet of FIG. 14 folded in two.

The base sheet 110 is folded in two along the center line CL as shown in FIG. 15. The folded-in-two base sheet 110*a* has a one second of its original length. The joining flap 139 is folded upwardly along the folding line 138 as indicated by arrow (k) and tucked under the flap 140*a* of the central region 114.

Figure 16:
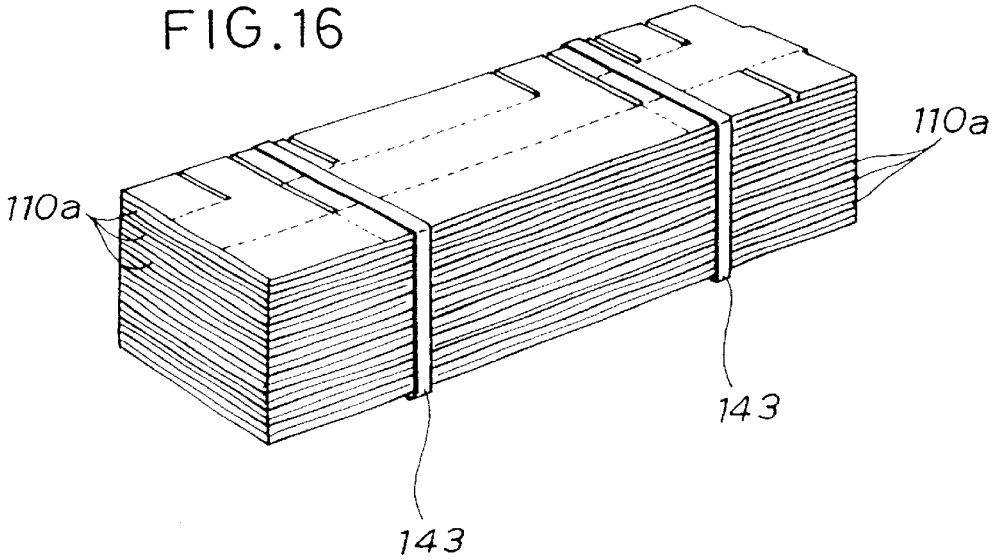
FIG. 16 is a perspective view illustrating a stack of base sheets folded in two as shown in FIG. 15, laid one over another in a horizontal orientation and then bound.

As shown in FIG. 16, a multitude of folded-in-two base sheets 110*a* is kept in a stacked state and bound by fastening belts 143, 143. The thus tacked base sheets 110*b* will not be damaged upon shipment thereof because they have no parts projecting outwardly which may be hooked or get caught by nearby obstacles.

Figure 17:
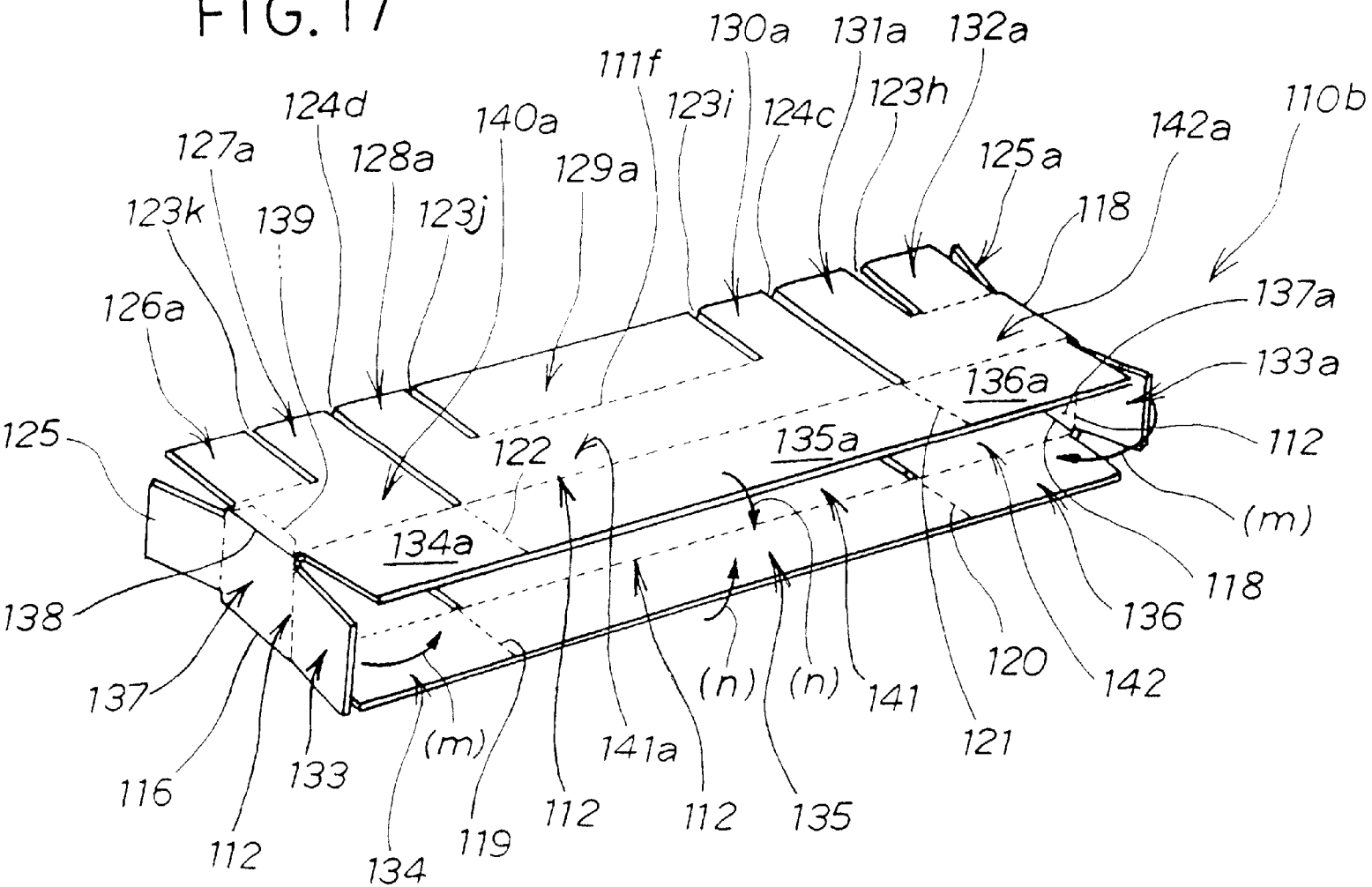
FIG. 17 is a perspective view illustrating a first stage of an operation for erecting the U-shaped box wherein the base sheet is folded into a sideways-long frame structure.

Reference is now made to FIG. 17 illustrating a first stage of the base sheet folding or erecting operation wherein the sideways-long frame structure 110*b* is obtained.

The joining flap 139 of FIG. 15 is joined with an inner surface of the flap 140*a* of the central region 114 by means of an adhesive tape. Next, the flap 137 is folded upwardly along the folding line 116, followed by folding the flap 137*a* upwardly along the folding line 118 to thereby provide the sideways-long frame structure 110*b* as shown in FIG. 17. The flap 137 and the flap 137*a* are opposed to each other.

Thereafter, the flaps 133, 133*a* continuing downwardly from the flaps 137, 127*a* are folded inwardly along the second folding lines 112, 112 as indicated by arrows (m), (m). Continuously, the continuing flaps 134*a*, 135*a* 136*a* are folded inwardly along the second folding line 112 as indicated by arrows (n). This is followed by folding the continuing flaps 134, 135, 135, 136 inwardly along the second folding line 112 as indicated by arrows (n), whereby a sideways-long, upwardly-opened rectangular box 110*c* is provided as shown in FIG. 18.

Figure 18:
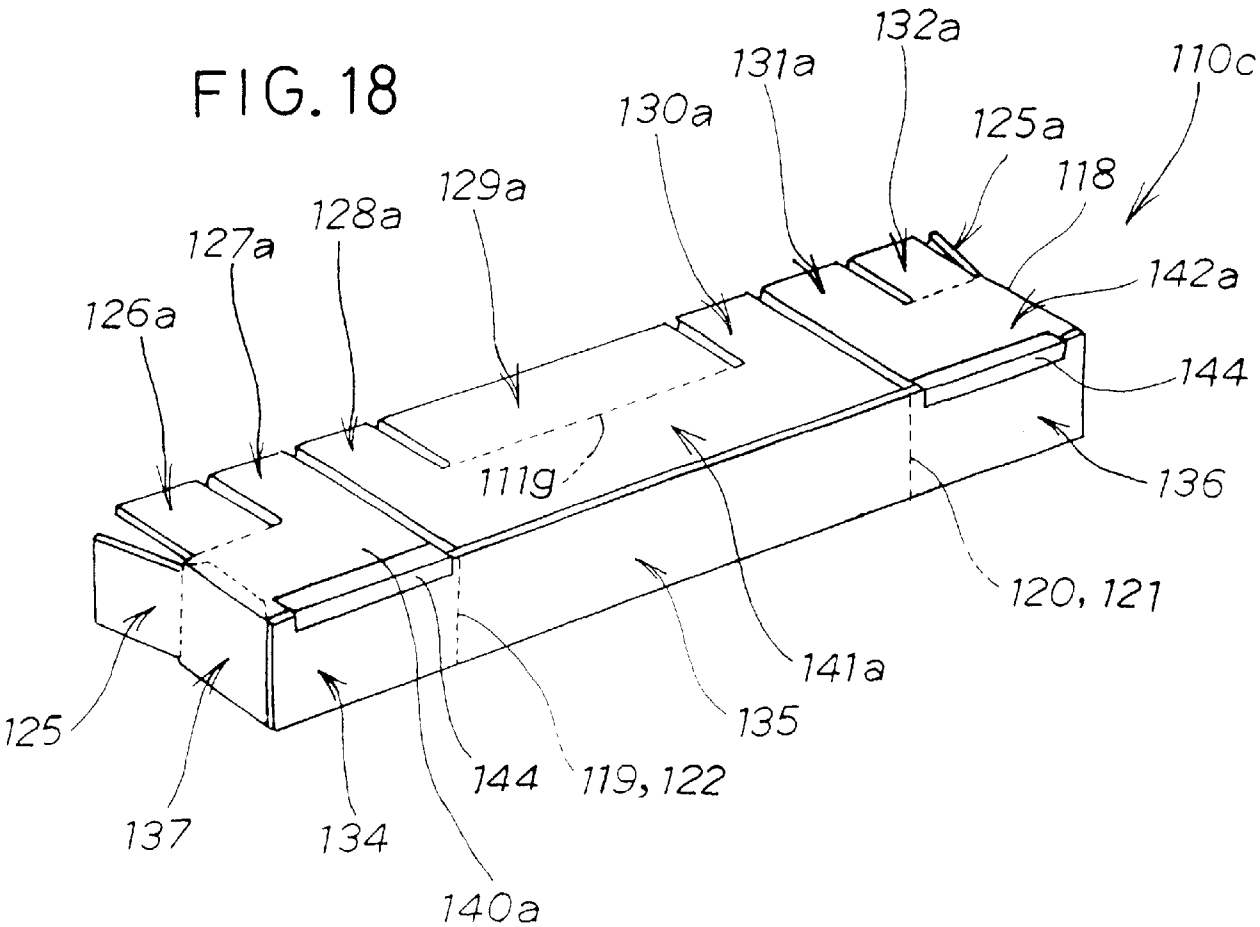
FIG. 18 is a perspective view illustrating a second stage of the erecting operation wherein a sideways-long box with its upper side opened is provided.

Referring to FIG. 18, a longitudinal edge portion of the flap 134 forming the bottom of the box 110*c* in its illustrated state is firmly connected with an edge portion of the flap 140*a* forming a side wall of the box 110*c* be means of an adhesive tape 144. Similarly, an edge portion of the flap 136 is firmly connected with an edge portion of the flap 142*a* by means of an adhesive tape 144.

Where the flap 133 is located, the bottom of the box 110*c* is three-layered with the flaps 133, 134*a* and 134. Similarly, where the flap 133*a* is located, the box bottom is three-layered with the flaps 133*a*, 136*a* and 136. Other part of the box bottom, where the flaps 133, 133*a* are not positioned, is two-layered with the flaps 134*a*, 134, flaps 135*a*, 135, and flaps 136*a*, 136 laid one over another.

Figure 19:
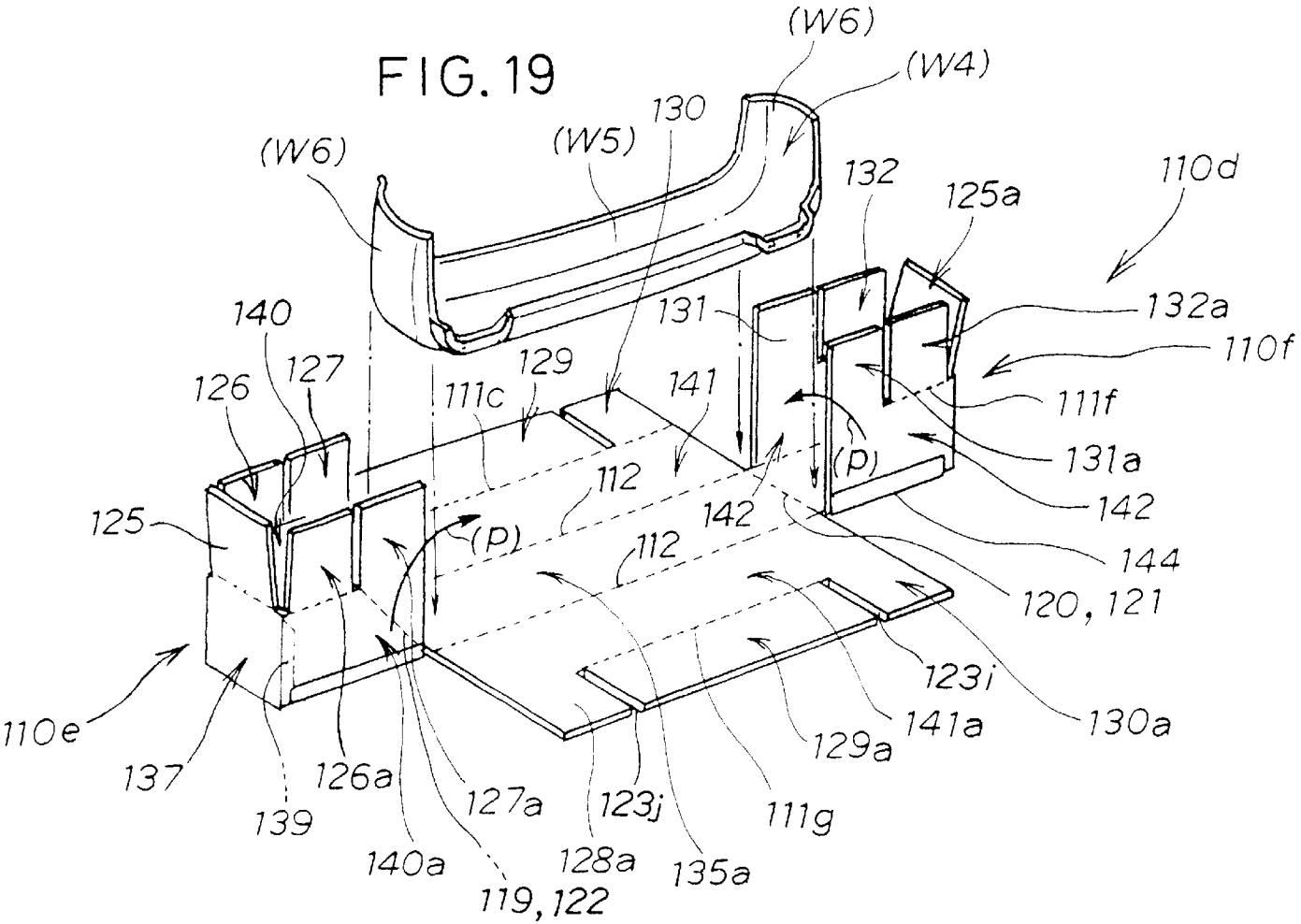
FIG. 19 is a perspective view illustrating a third stage of the erecting operation wherein once folded central flaps are unfolded.

In FIG. 19, the box 110*c* is illustrated in an upright state with its bottom positioned underside and with its opened side positioned upwardly, in conjunction with a U-shaped product W4 to be packed in the box 110*c*.

The flaps 141 and 141*a* forming the side walls of the box 110*c* are folded over outwardly along the second folding lines 112, 112. The box with these flaps opened will be referenced by numeral 110*d*.

With the box sides thus fold opened, the U-shaped product W4 such as a resinous bumper is placed on the flap 135*a* such that a sideways-long frontal part W5 is positioned underside while curved opposite ends W6, W6 faced upwardly.

Box portion 110*e* including the flaps 137, 140*a* is folded inwardly through 90 degrees about the folding lines 119, 122 as indicated by arrow (p). Similarly, box portion 110*f* including the flaps 142, 142*a* is folded inwardly through 90 degrees about the folding lines 120, 121 as indicated by arrow (p).

Figure 20:
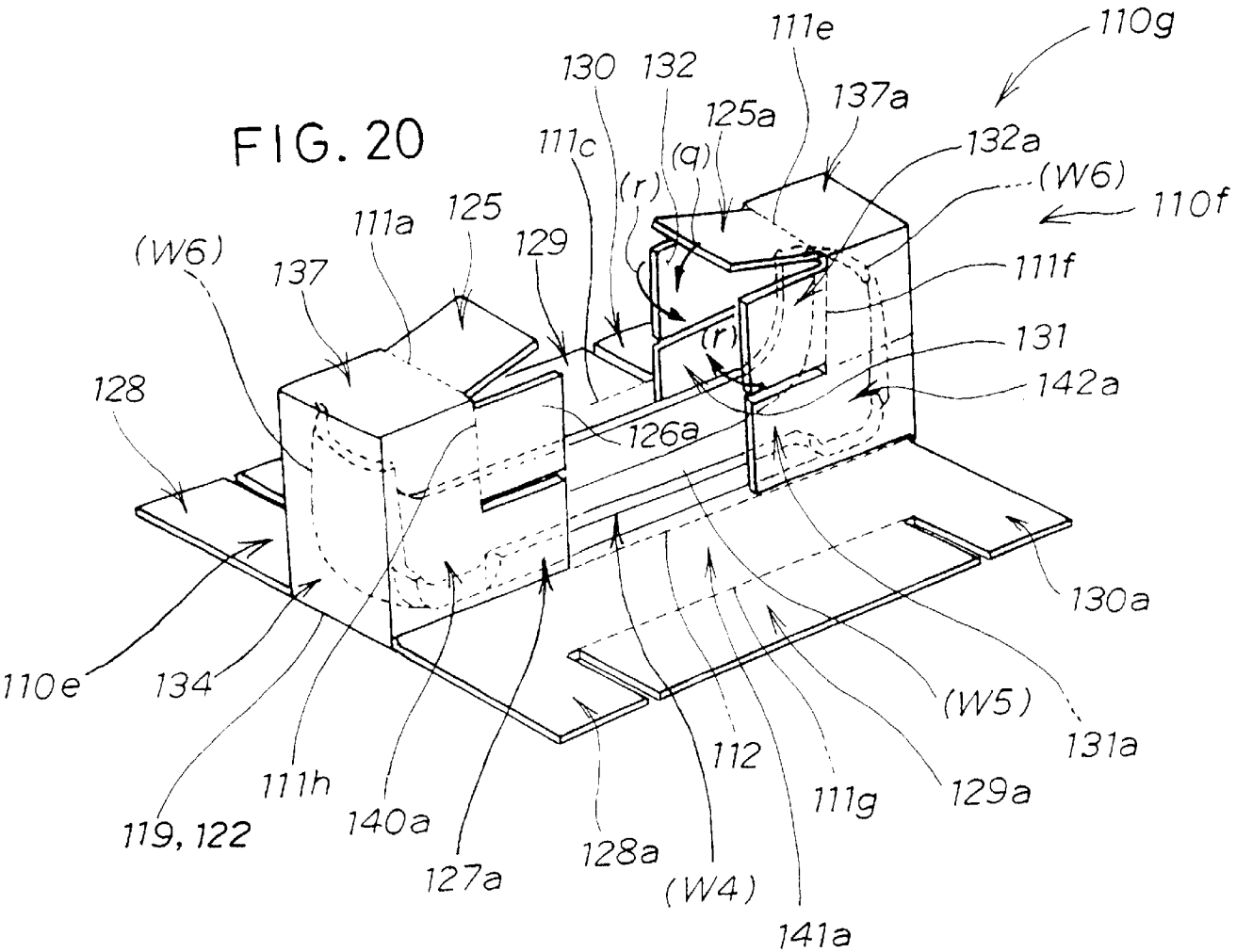
FIG. 20 is a perspective view illustrating a fourth stage of the erecting operation wherein by folding opposite side portions of the box, upright portions are provided to thereby obtain the U-shaped box.

Before folding, the box portions 110*e*, 110*f* are opened at their tops as shown in FIG. 19. After the box portions are folded, their tops are oriented inwardly and opposed to each other as shown in FIG. 20. Thus, the side portions W6, W6 of the bumper W4 are received in the box portions 110*e*, 110*f*. FIG. 20 thus shows the box 110*g* with its box portions 110*e*, 110*f* folded.

Then, the flap 125*a* is folded downwardly along the folding line 111*e* as shown by arrow (q). Thereafter, the flap 132 is folded inwardly as shown by arrow (r), followed by folding the flap 132*a* inwardly as shown by arrow (r). Similarly, the flap 125 of the box portion 110*e* is folded downwardly, followed by folding the flap 126 (FIG. 19) inwardly. This is further followed by folding the flap 126*a* inwardly. Continuously, the flap 132*a* and the flap 126*a* are joined together at their edges by an adhesive tape 145 as shown in FIG. 21.

Figure 21:
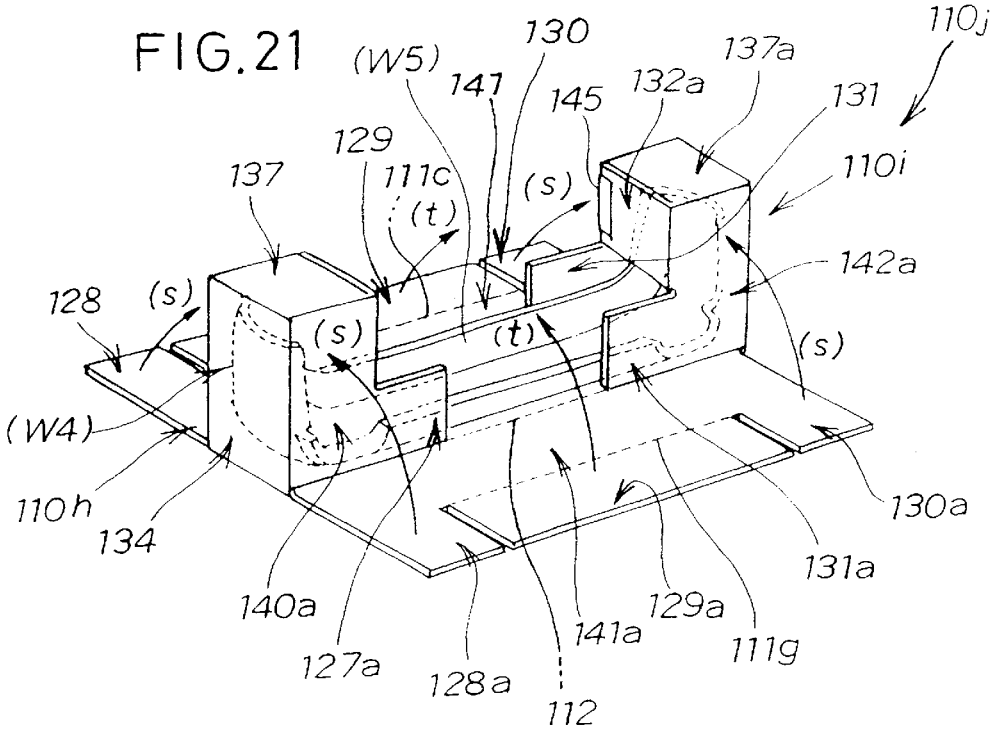
FIG. 21 is a perspective view illustrating a final stage of the erecting operation wherein opposed portions of the upright portions are folded and connected together by an adhesive tape.

In FIG. 21, the box 110*j* is shown to have the box portions 110*h*, 110*i* closed at upper halves thereof. Opposed walls of the box portions 110*h*, 110*i* are of triple structure. That is, that wall of the box portion 110*i* which is opposed to the box portion 110*h* is three-layered with the flaps 125*a*, 132, 132*a* as shown in FIG. 20. Similarly, that wall of the box portion 110*h* which is opposed to the box portion 110*i* is three-layered with the flaps 125, 126 (see FIG. 19), 126*a* as shown in FIG. 20.

In the state of FIG. 21, the flaps 141 and 141*a* are folded toward the box portions 110*h*, 110*i* as indicated by arrows (s), (s).

One side of the box portion 110*h* where the flaps 140*a*, 127*a* are positioned is double structured by the addition of the flaps 141*a*, 128*a*. Similarly, another side of the box portion 110*h* where the flaps 140, 127 (FIG. 19) are positioned is double structured by the addition of the flaps 141, 128. In addition, one side of the box portion 110*i* where the flaps 142*a*, 131*a* are positioned is double structured by the addition of the flaps 141*a*, 130*a*. Similarly, another side of the box portion 110*i* where the flaps 142, 131 (FIG. 19) are positioned is dual structured by the addition of the flaps 141, 130.

Figure 22:
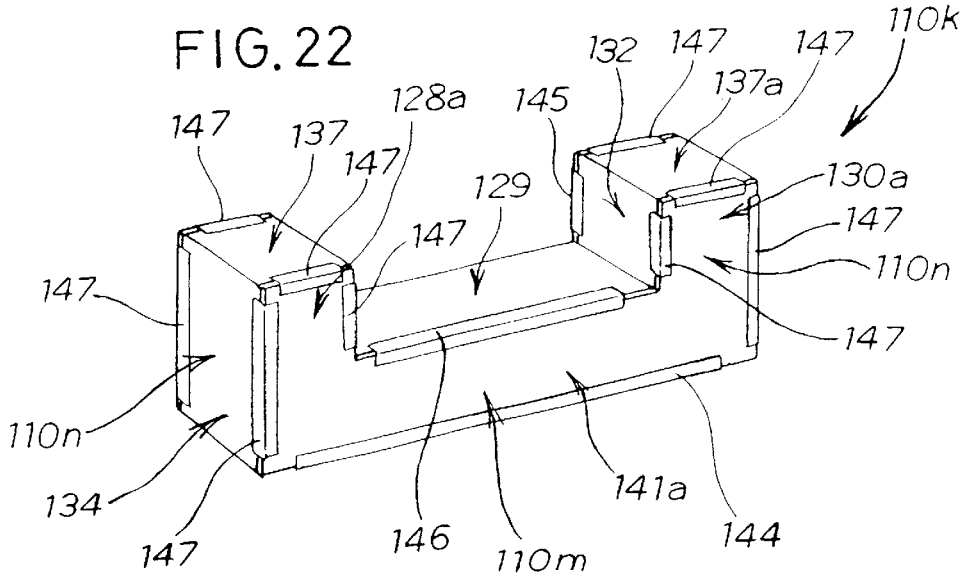
FIG. 22 is a perspective view illustrating the U-shaped packing box completely erected.

The flap 129*a* defined on the flap 141*a* by the folding line 111*g* is folded inwardly along the folding line 111*g* as indicated by arrow (t) in FIG. 21. Thereafter, the flap 129 defined on the flap 141*a* by the folding line 111*c* is folded inwardly along the folding line 111*c* as indicated by arrow (t) in FIG. 21. This is followed by connecting an edge of the flap 129 and an edge of the flap 141*a* together by means of an adhesive tape 146, as shown in FIG. 22. Other corner portions are also firmly joined by adhesive tapes 147.

FIG. 22 illustrates the U-shaped packing box 110*k* which stores the product or bumper W4 and is almost through with its packing operation. The packing box 110*k* includes a central box-shaped body portion 110*m* and upright portions 110*n*, 110*n* continuing from the body portion 110*m*. The flap 129 forming the ceiling part of the body portion 1110*m* internally laid on the flap 129*a* of FIG. 21 to thereby provide a dual structure.

Figure 23:
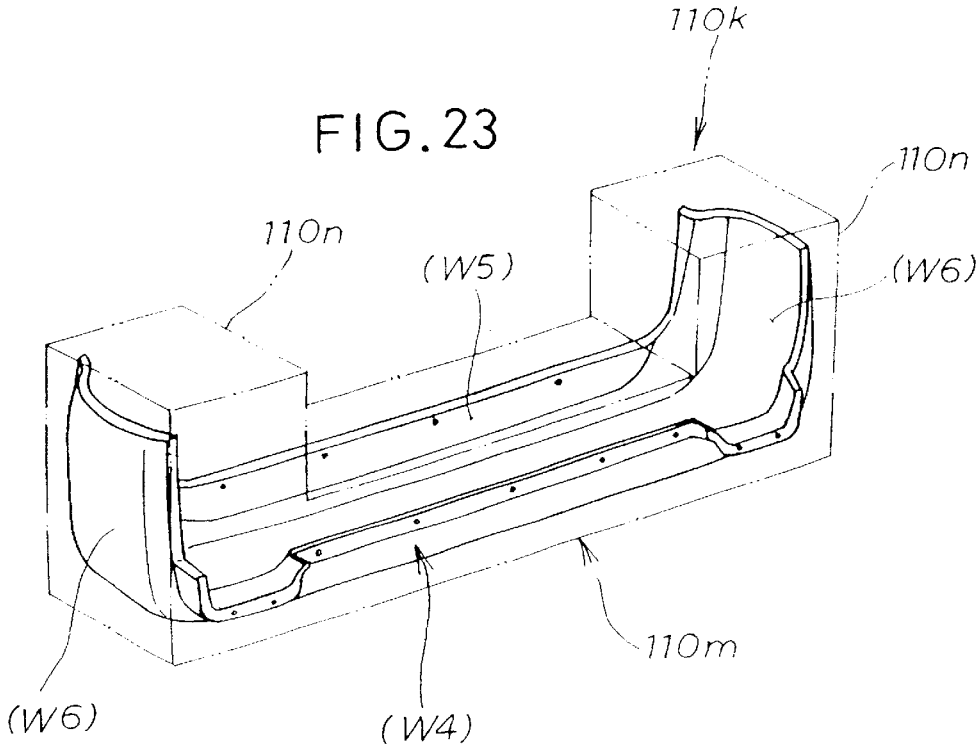
FIG. 23 is a perspective view illustrating the U-shaped packing box with the U-shaped product packed therein.

In FIG. 23, the thus-obtained packing box 110*k* is illustrated with the bumper W4 packed therein. Frontal part W5 of the product W4 is received in the body portion 110*m* of the packing box 110*k*. Bent ends W6, W6 of the product W4 are received in the upright portions 110*n*, 110*n* of the packing box 110*k*.

Figure 24:
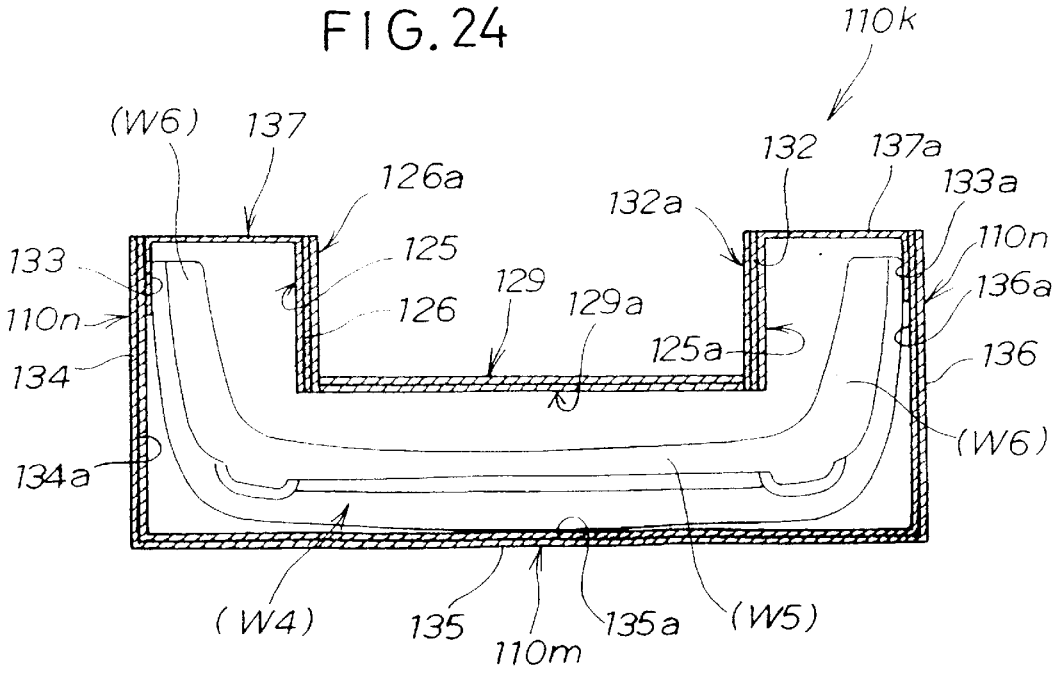
FIG. 24 is a cross-sectional view taken vertically centrally of the U-shaped packing box.

FIG. 24 illustrates in section the U-shaped packing box 110*k* with the bumper 4W packed therein. An inner side of one of the upright portions 110*n* of the packing box 110*k* is three-layered with the flaps 125, 126, 126*a*. Similarly, an inner side of the other one of the upright portions 110*n* is three-layered with the flaps 125*a*, 132, 132*a*. Bottom of the body 110*m* of the packing box 110*k* is two-layered with the flaps 135, 135*a*.

Most part of an outer side of the one upright portion 110*n* is two-layered with the flaps 134, 134*a*. Upper part of the outer side of the one upright portion 110*n* is three-layered with the flaps 133, 134, 134*a*. Similarly, most part of an outer side of the other one upright portion 110*n* is also two-layered with the flaps 136, 136*a*, while upper part of the outer side of the other one upright portion 110*n* is three-layered with the flaps 133*a*, 136, 136*a*. Rigidity-requiring corner portions of the packing box 110*k* are thus reinforced by making them three-layered.

Further, the ceiling part of the body 110*m* of the packing box 110*k* is two-layered with the flaps 129, 129*a*. In addition, the opposite sides of the packing box 110*k* are two-layered at most of their corner portions, as explained in connection with FIG. 22.

Figure 25:
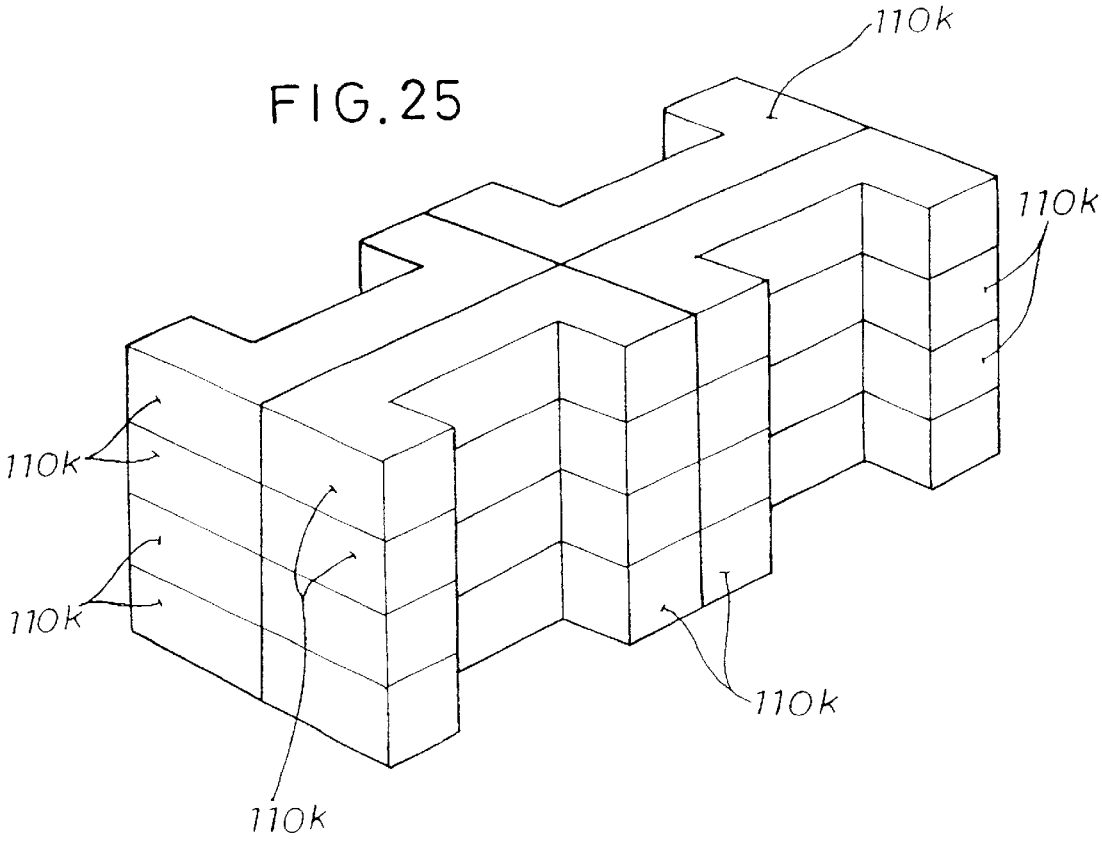
FIG. 25 is a perspective view illustrating a multitude of U-shaped packing boxes containing the U-shaped product packed therein and piled up in a stack.

As thus far explained, the packing box according to the second embodiment is three-layered at most of its corner portions and two-layered at other corner portions. Consequently, when a multitude of packing boxes 110*k* are stacked high by horizontally laying them one over the other as shown in FIG. 25, there is no fear that ones positioned at a lower level will be undesirably deformed and damaged.

INDUSTRIAL APPLICABILITY

As explained above, the packing box according to the present invention is designed for packing an L- or U-shaped product while being erected by folding a single base sheet. It is most suited for packing an automobile front fender or a bumper.

What is claimed is:

1. A packing box for packing a product having at least one bent portion, said packing box being erected by folding a single rectangular base sheet along folding lines and slits formed on said base sheet such that the product including the bent portion is entirely covered, said base sheet comprising:

first and second longitudinal folding lines extending longitudinally of said base sheet for dividing said base sheet into three laterally separated regions;

a plurality of separate lateral folding lines provided on a center region and on one of first and second outer side regions of said three regions divided by said first and second folding lines such that they extend perpendicularly to said first and second folding lines;

a plurality of short slits provided in said first and second outer side regions of said regions such that they extend perpendicularly to said first and second folding lines;

a plurality of long slits extending through the widths of said second outer side region and said central region of said regions and being parallel to said short slits; and a plurality of flaps defined by said first and second folding lines, said separate lateral folding lines, said short slits and said long slits, so that the product can be packed in the box while erecting the same.

2. A packing box according to claim 1, wherein said packing box has wall portions and said wall portions are at least two-layered so that said box can endure a vertical load applied when said box is positioned at a lower level of a stack of such boxes.

3. A packing box according to claim 1, wherein said box comprises a body portion erected by folding said base sheet along said folding lines and said slits, and an upright portion integral with and rising at right angle from at least one end of said body portion.

4. A packing box according to claim 1, wherein said packing box has an L-shaped configuration so that it can pack an L-shaped product.

5. A packing box according to claim 1, wherein said packing box has a U- or channel-shaped configuration so that it can pack a U- or channel-shaped product.

6. A packing box according to claim 1, wherein said base sheet comprises a sheet of corrugated cardboard.

7. A packing box according to claim 1, wherein said base sheet is made from a water-, humidity- and wear-resistant material.

8. A packing box according to claim 1, wherein said first longitudinal folding line comprises six line segments occurring intermittently along the length of said base sheet said second longitudinal folding line comprises six line segments occurring continuously along the length of said base sheet, said separate lateral folding lines provided On said central region comprise four, said separate lateral folding lines provided on said first outer side region comprise two, said short slits provided on said first outer side region comprise three, said short slits provided on said second outer side region comprise seven, said long slits comprise two extending from a long side of said second outer side region to said second longitudinal folding line, said first outer side region comprise six flaps divided by said second longitudinal folding line, said two lateral folding lines provided thereon, and said three short slits provided thereon, said second outer side region comprise ten flaps divided by said first longitudinal folding line, said seven lateral short slits provided thereon, and said two long slits provided thereon, and said central region comprises six flaps divided by said first and second longitudinal folding lines, said four lateral folding lines provided thereon, and said two long slits.

9. A packing box according to claim 1, wherein said first longitudinal folding line comprises eight line segments occurring intermittently along the length of said base sheet, said second longitudinal folding line comprises eight line segments occurring continuously along the length of said base sheet, said lateral folding lines provided on said central region comprise four, said lateral folding lines provided on said first outer side region comprise four, said short slits provided on said first outer side region comprise three, said short slits provided on said second outer side region comprise eleven, said long slits comprise four extending from a long side of said second outer side region to said second folding line, said first outer side region comprise eight divided by said second folding line, said four lateral folding lines provided thereon, and said three slits provided thereon, said second outer side region comprise sixteen divided by said fist folding line, said eleven short slits provided thereon, and said four long slits, and said central region comprises eight flaps divided by said first and second folding lines, said four lateral folding lines provided thereon, and said four long slits.

10. A packing box for packing a product comprising: at least one bent portion, said packing box being erected by folding a single rectangular base sheet along folding lines and slits formed on said base sheet such that the product including the bent portion is entirely covered, said base sheet comprising:

a first folding line discontinuously extending longitudinally of said base sheet;

a second folding line continuously extending longitudinally of said base sheet in parallel with said first folding line for, together with said fist folding line, dividing said base sheet into three laterally separated regions, said three regions including opposed outer regions and a central region positioned therebetween;

a plurality of first short slits provided in one of said outer regions such that they extend from a long side of said one outer region to said second folding line;

a plurality of second short slits provided in the other one of said outer regions such that they extend from a long side of said other outer region to said first folding line;

a plurality of long slits provided in said other outer region such that they extend from said long side of said other outer region to said second folding line;

a plurality of third folding lines provided in said one outer region such that they extend from said long side of said one outer region to said second folding line in axially aligned relation to said long slits;

a plurality of fourth folding lines provided in said central region such that they extend between said first and second folding lines in axially aligned relation to said first and second short slits; and a plurality of flaps defined by said first and second folding lines, said third and fourth folding lines, said first and second short slits, and said long slits, so that said base sheet can be folded along said third and fourth folding lines and said slits into a tubular shape and then into said packing box having at least one bent portion by folding at least part of said tubular-shaped base sheet relative to another part of said tubular-shaped base sheet.

* * * * *